US006062674A

United States Patent [19]

Inui et al.

[11] Patent Number: 6,062,674

[45] **Date of Patent: *May 16, 2000**

[54] METHOD AND APPARATUS FOR INK-JET PRINTING

[75] Inventors: Toshiharu Inui; Keiichi Murai; Hiromitsu Hirabayashi, all of Yokohama; Mayumi Yamamoto, Tokyo; Yoshihisa Takizawa, Machida; Miyuki Fujita, Tokyo; Fumihiro Gotoh, Kawasaki; Masaya Uetsuki; Mikio Sanada, both of Yokohama; Eriko Saito, Fujisawa, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/588,416

[22] Filed: Jan. 18, 1996

[30] Foreign Application Priority Data

| | | | |
|---|---|---|---|
| Feb. 13, 1995 | [JP] | Japan | 7-023589 |
| Jan. 12, 1996 | [JP] | Japan | 8-004377 |

[51] Int. Cl.[7] ..... B41J 2/21

[52] U.S. Cl. ..... 347/43

[58] Field of Search ..... 347/43, 96, 100

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,538,160 | 8/1985 | Uchiyama | 347/101 |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,181,045 | 1/1993 | Shields et al. | 347/43 |
| 5,198,023 | 3/1993 | Stoffel | 106/31.32 |
| 5,555,008 | 9/1996 | Stoffel et al. | 347/100 |
| 5,635,969 | 6/1997 | Allen | 347/96 |

FOREIGN PATENT DOCUMENTS

| | | | |
|---|---|---|---|
| 54-56847 | 5/1979 | Japan . | |
| 58-128862 | 8/1983 | Japan . | |
| 59-123670 | 7/1984 | Japan . | |
| 59-138461 | 8/1984 | Japan . | |
| 60-71260 | 4/1985 | Japan . | |
| 62-161541 | 7/1987 | Japan | 347/43 |
| 1-105773 | 4/1989 | Japan . | |
| 6-57192 | 3/1994 | Japan . | |
| 6-100811 | 4/1994 | Japan . | |
| 6-135006 | 5/1994 | Japan | 347/43 |
| 6-191143 | 7/1994 | Japan . | |

*Primary Examiner*—N. Le
*Assistant Examiner*—Hai Pham
*Attorney, Agent, or Firm*—Fitzpatrick, Cella, Harper & Scinto

[57] ABSTRACT

When a black image region is printed, the overall pixels in the region is printed by a black ink. Then, a cation type cyan ink which makes a coloring agent in the ink insoluble is printed on the pixels of a predetermined pattern. By this, the dye of the black ink is maintained near the surface of the printing medium to increase density of the black image. At the same time, for preventing variation of tone of the black image, the pixels of the predetermined pattern are printed by a yellow ink.

37 Claims, 16 Drawing Sheets

METHOD AND APPARATUS FOR INK-JET PRINTING

BACKGROUND OF THE INVENTION

1. Field of the Invention

The present invention relates generally to an ink-jet printing apparatus and an ink-jet printing method. More specifically, the invention relates to an ink-jet printing apparatus and an ink-jet printing method for performing printing by ejecting an ink and a processing liquid for making coloring agent in the ink insoluable or coagulated, to a medium to be printed.

The present invention is applicable for all of devices or apparatus employing paper, cloth, non-woven fabric, OHP sheet and so forth as a printing medium. In concrete terms, the present invention is applicable for office appliances, such as a printer, a copy machine, a facsimile and so forth, and industrial production machines or so forth.

2. Description of the Prior Art

An ink-jet printing system is a non-impact type printing system for printing characters, graphic images and so forth on a printing medium, such as a paper, cloth, plastic sheet and so forth (hereinafter referred to as a printing paper) by directly ejecting an ink, and thus is a low noise printing system. Also, this system is advantageous for low running cost and ease of down-sizing and providing color printing capability for the apparatus, for the reason that no uncomplicated apparatus is required in implementation. Since the ink-jet printing system holds various advantages stated above, the system has been widely employed in printers, copy machines, facsimiles, wordprocessors and so forth.

On the other hand, in case of a color printing apparatus employing the ink-jet system, it is occasionally required to use a dedicated printing paper for obtaining a highly developed color image without bleeding between different colors of inks. However, in the recent years, according to improvement of the inks, inks adapted to printing on a plain paper have become available for practical use.

However, even in employing such inks, it is still possible that the quality of printing becomes unsatisfactory depending upon the printing condition.

More specifically, when a color image is printed on the plain paper, in consideration of bleeding, a quick dry ink having high permeation speed to the plain paper is employed. However, in such case, while bleeding between the inks can be prevented, the portion printed in black causes lack of density and the portion printed in other color of ink is poor in color development. Also, in case of a line image, typically characters and so forth, blurring, referred to as feathering, along the fiber of the paper becomes perceptible so that quality of a printing image is degraded. The characters of a black ink specifically becomes perceptible and have no sharpness.

On the other hand, in the ink-jet printing system, various measures set out below have been known for enhancing the density of black image to be printed.

First of all, there is a method to eject black inks for a plurality of times for the same pixel. In this method can be realized by so-called multi-path printing system, in which scanning for one pixel is performed for a plurality of times, or by a system lowering a carriage speed without varying the ejection frequency. Both systems inherently cause a derivative problem of lowering of the printing speed to cause lowering of the through-put of the overall apparatus. Also, in such method to eject the ink for a plurality of times, the possibility of bleeding of the ink becomes high. If the bleeding is caused between the black image portion and other color image portion, the image quality can be significantly degraded.

On the other hand, as second and third measures, a method of increasing an ink ejection amount for the black ink or a method of ejecting other color ink on the black ink have been known in the art.

Increasing the ejection amount of the black ink can be realized by widening an area of an ejection heater of an ink-jet head and thus increasing thermal energy to be applied for the ink, for example. However, when the ink ejection amount is increased in this manner, for the reason of increasing of influence of pressure wave of the ink, a refill frequency is generally lowered. Also, when the ejection heater area is increased, it may cause increasing of power consumption.

In the third method to eject other color ink overlapping with the black ink, increasing of density is relatively low despite of increasing of the ejected ink amount. To the contrary, a significant problem of thickening of the character may be caused. A reason why satisfactory gain of density cannot be obtained in this method is that in view of necessity of avoiding bleeding for ejection of large amount of ink to the printing medium, ink having high permeation ability is employed to be quickly permeated in a printing medium to lower the effect of overlapping ejection.

As a fourth method for increasing density of the black image, it has been known to accelerate drying of the ink by means of a heater or so forth. This method is effective for preventing bleeding of ink which may otherwise be caused when a large amount of ink is ejected as set out with respect to the first to third methods and to enhance color development. However, this method inherently causes increasing of a cost of the apparatus and of a size of the apparatus.

Furthermore, as a fifth method for increasing the density of the black image, it has been known to increase density of the dye. However, increasing of dye concentration in the ink inherently causes increasing of a viscosity of the ink to increase the possibility of solidifying of the ink in ejection orifices or ink passages of the ink-jet head to make it difficult to assure reliability of ejection.

In addition, in a different viewpoint from the methods set forth above, namely for directly increasing the density of the printed image, a method for performing printing by ejecting an ink and a processing liquid for making the ink insoluble for prevention of bleeding of ink and fastness of the printed image, has been known in the art.

This method may be realized in two constructions. One is to employ an achromatic processing liquid. Another is to employ a chromatic processing liquid, namely to make the processing liquid serve as one of the inks.

The latter has an advantage in that no additional head for the processing liquid is required. One example has been disclosed in Japanese Patent Application Laid-open No. 105773/1989. Also, the former has been disclosed in Japanese Patent Application Laid-open No. 128862/1983.

However, the above-identified two publications, in which the processing liquid or the processing liquid serving as the ink is employed, there is only disclosed constructions for ejecting ink and so forth from a plurality of heads in an overlapping manner. These publications do not have a positive statement for increasing of the density of the lower image.

SUMMARY OF THE INVENTION

It is an object of the present invention to provide an ink-jet printing apparatus, in which consideration is given for use of a processing liquid making an ink insoluble and employing the latter construction to use the processing liquid as one of the ink so that making the ink insoluble may contribute to increasing the density of the black image.

Another object of the present invention is to provide an ink-jet printing apparatus which can unify color tones in the construction providing increased density of the black image.

A further object of the present invention is to provide an ink-jet printing apparatus, in which an ink containing a component for making a coloring agent insoluble or coagulating is ejected for the portion where a black ink is ejected in overlapping manner to maintain a dye of the black ink on the surface of a printing medium without causing permeation to increase density of the black image, and in conjunction therewith, a tone adjustment can be done by ejecting other kind of an ink to the portion where the black ink is ejected or the portion in the vicinity of the portion where the black ink is ejected.

In a first aspect of the present invention, there is provided an ink-jet printing apparatus performing printing by ejecting at least one kind of ink and an ink composition containing a component making a coloring agent in the ink insoluble or coagulated, to a printing medium, comprising:

moving means for moving a plurality of first ejecting portions for ejecting the at least one kind of ink and a second ejecting portion for ejecting the ink composition relative to the printing medium in at least one direction;

arranging means for arranging the plurality of first ejecting portions and the second ejecting portion in the at least one direction; and printing control means for controlling relative movement by the moving means and an ejection to eject ink from one of the plurality of ejecting portions, to eject the ink composition from the second ejecting portion to a portion where the ink from the one of the plurality of first ejecting portions is to be ejected, one of the ink to be ejected and the ink composition containing a black ink, and to eject the ink other than the black ink from at least one of the plurality of first ejecting portions to a portion where the black ink is ejected or a portion in the vicinity thereof, so that printing for a black pixel is performed.

In a second aspect of the present invention, there is provided an ink-jet printing apparatus performing printing by ejecting a plurality of kinds of inks and an ink composition containing a component making a coloring agent in the ink insoluble or coagulated, to a printing medium, comprising:

a plurality of first ejecting portions ejecting the plurality of kinds of inks;

a second ejecting portion ejecting the ink composition;

setting means for setting a black enhanced mode performing printing by increasing density of a black image; and black enhanced mode executing means for, when the black enhanced mode is set, controlling an ejection to eject ink from one of the plurality of ejecting portions, to eject the ink composition from the second ejecting portion to a portion where the ink from the one of the plurality of first ejecting portions is to be ejected, one of the ink to be ejected and the ink composition containing a black ink, and to eject the ink other than the black ink from at least one of the plurality of first ejecting portions to a portions where the black ink is ejected or a portion in the vicinity thereof, so that printing for a black pixel is performed.

In a third aspect of the present invention, there is provided an ink-jet printing apparatus performing printing by ejecting at least one kind of ink and an ink composition containing a component making a coloring agent in the ink insoluble or coagulated, comprising:

a plurality of first ejecting portions ejecting the at least one kind of ink;

a second ejecting portion ejecting the ink composition;

setting means for setting a black enhanced mode performing printing by increasing density of a black image;

black enhanced mode executing means for, when the black enhanced mode is set, controlling an ejection to eject the ink from one of the plurality of first ejecting portions, and to eject the ink composition from the second ejecting portion to the portion where the ink is to be ejected, one of the ink to be ejected and the ink composition containing a black ink, so that printing for a black pixel is performed.

In a fourth aspect of the present invention, there is provided an ink-jet printing method for performing printing by ejecting a plurality of kinds of inks including at least black ink, and an ink containing a component making a coloring agent in the ink insoluble or coagulated, to a printing medium, comprising the steps of:

providing the plurality of first ejecting portions ejecting the plurality of kinds of inks and a second ejecting portion ejecting the ink containing the component making the coloring agent in the ink ejected through the first ejecting portions insoluble or coagulated; and printing a black pixel by ejecting a black ink from one of the plurality of first ejecting portions, by ejecting the ink containing the component from the second ejecting portion to the portion where the black ink is to be ejected, and by ejecting the ink other than the black ink from one of the plurality of first ejecting portions to a portion where the black ink is to be ejected or a portion in the vicinity thereof.

In a fifth aspect of the present invention, there is provided an ink-jet printing method for performing printing by ejecting at least one kind of ink and an ink composition containing a component making a coloring agent in the ink insoluble or coagulated, to a printing medium, comprising the steps of:

providing a plurality of first ejecting portions ejecting the at least one kind of ink, and providing a second ejecting portion ejecting the ink composition;

setting a black enhanced mode performing printing by increasing density of a black image; and printing a black pixel by, when the black enhanced mode is set, controlling to eject ink from one of the plurality of ejecting portions, to eject the ink composition from the second ejecting portion to a portion where the ink from the one of the plurality of first ejecting portion is to be ejected, one of the ink to be ejected and the ink composition containing a black ink, and to eject the ink other than the black ink from at least one of the plurality of first ejecting portions to a portion where the black ink is ejected or a portion in the vicinity thereof.

In a sixth aspect of the present invention, there is provided an ink-jet printing method for performing printing by ejecting at least one kind of ink and an ink composition containing to a printing medium, a component making a coloring agent in the ink insoluble or coagulated, to a printing medium, comprising the steps of:

providing a plurality of first ejecting portions ejecting the at least one kind of ink, and providing a second ejecting portion ejecting the ink composition;

setting a black enhanced mode performing printing by increasing density of a black image; and printing a black pixel by, when the black enhanced mode is set, controlling an ejection to eject the ink from one of the plurality of first ejecting portions, to eject the ink composition from the second ejecting portion to a portion where the ink is to be ejected, one of the ink to be ejected and the ink composition containing a black ink.

In a seventh aspect of the present invention, there is provided a method for enhancing a black pixel in an ink-jet printing for performing printing by ejecting a plurality of inks including at least black ink, and an ink containing a component making a coloring agent in the plurality of inks insoluble or coagulated, to a printing medium, comprising the steps of:

providing the plurality of first ejecting portions ejecting the plurality of kinds of inks and a second ejecting portion ejecting the ink containing the component making the coloring agent in the ink ejected through the first ejecting portions insoluble or coagulated; and printing a black pixel by ejecting a black ink from one of the plurality of first ejecting portions, by ejecting the ink containing the component from the second ejecting portion to the portion where the black ink is to be ejected, and by ejecting the ink other than the black ink from one of the plurality of first ejecting portions to a portion where the black ink is to be ejected or a portion in the vicinity thereof.

In an eighth aspect of the present invention, there is provided a method for enhancing a black pixel in an ink-jet printing for performing printing by ejecting at least one kind of ink and an ink composition containing a component making a coloring agent in the ink insoluble or coagulated, to a printing medium, comprising the steps of:

providing a plurality of first ejecting portions ejecting the at least one kind of ink, and providing a second ejecting portion ejecting the ink composition;

setting a black enhanced mode performing printing by increasing density of a black image; and printing a black pixel by, when the black enhanced mode is set, controlling to eject ink from one of the plurality of ejecting portions, to eject the ink composition from the second ejecting portion to a portion where the ink from the one of the plurality of first ejecting portion is to be ejected, one of the ink to be ejected and the ink composition containing a black ink, and to eject the ink other than the black ink from at least one of the plurality of first ejecting portions to a portion where the black ink is ejected or a portion in the vicinity thereof.

In a ninth aspect of the present invention, there is provided a method for enhancing a black pixel in an ink-jet printing for performing printing by ejecting at least one kind of ink and an ink composition containing a component making a coloring agent in the ink insoluble or coagulated, comprising the steps of:

providing a plurality of first ejecting portions ejecting the at least one kind of ink, and providing a second ejecting portion ejecting the ink composition;

setting a black enhanced mode performing printing by increasing density of a black image; and printing a black pixel by, when the black enhanced mode is set, controlling an ejection to eject the ink from one of the plurality of first ejecting portions, to eject the ink composition from the second ejecting portion to a portion where the ink is to be ejected, one of the ink to be ejected and the ink composition containing a black ink.

In a tenth aspect of the present invention, there is provided a dot forming method forming a black type pixel by employing a black type ink and a color ink having color different from the black type color, and by mixing or contacting of the black type ink with the color inks, wherein a first component contained in the black type ink and a second component contained in the color ink are components causing mutual chemical reaction.

In a eleventh aspect of the present invention, there is provided a printed product formed by forming a plurality of dots by ejecting an ink and an ink composition containing a component making a coloring agent in the ink insoluble or coagulated to a printing medium, wherein at least one of a plurality of dots are formed by a component in the ink and a component in the ink composition, and one of the ink and the ink composition includes a black coloring agent, and the black coloring agent is made insoluble or coagulated on the printing medium.

In a twelfth aspect of the present invention, there is provided an ink-jet printing apparatus performing printing by ejecting at least one kind of ink and an ink composition containing a component making a coloring agent in the ink insoluble or coagulated, to a printing medium, comprising:

moving means for moving a plurality of first ejecting portions for ejecting the at least one kind of ink and a second ejecting portion for ejecting the ink composition relative to the printing medium; and printing control means for controlling relative movement by the moving means and an ejection to eject ink from one of the plurality of ejecting portions, and to eject the ink composition from the second ejecting portion to a portion where the ink from the one of the plurality of first ejecting portions is to be ejected, one of the ink to be ejected and the ink composition containing a black ink, so that printing for a black pixel is performed.

In a thirteenth aspect of the present invention, there is provided an ink-jet printing apparatus performing printing by ejecting at least one kind of ink other than black ink and a black ink composition containing a component making a coloring agent in the ink insoluble or coagulated, to a printing medium, comprising:

moving means for moving a first ejecting portion for ejecting the at least one kind of ink and a second ejecting portion for ejecting the black ink composition relative to the printing medium; and printing control means for controlling relative movement by the moving means and an ejection to eject only the black ink composition from the second ejecting portion to a black image region, and to eject the at least one kind of ink from the first ejecting portion to an image region of color other than black color in accordance with image data.

In a fourteenth aspect of the present invention, there is provided an ink-jet printing apparatus performing printing by ejecting at least one kind of ink and an ink composition containing a component making a coloring agent in the ink insoluble or coagulated, to a printing medium, comprising:

moving means for moving a plurality of first ejecting portions for ejecting the at least one kind of ink and a second ejecting portion for ejecting the ink composition relative to the printing medium; and printing control means for controlling relative movement by the moving means and an ejection to eject ink from one of the plurality of ejecting portions, to eject the ink composition from the second ejecting portion to a portion where the ink from the one of the plurality of first ejecting portions is to be ejected, one of the ink to be ejected and the ink composition containing a black ink, and to eject the ink other than the black ink from at least one of the plurality of first ejecting portions to a portion where the black ink is ejected or a portion in the vicinity thereof, so that printing for a black pixel is performed.

In a fifteenth aspect of the present invention, there is provided an ink-jet printing method for performing printing by ejecting at least one kind of ink and an ink composition containing a component making a coloring agent in the ink insoluble or coagulated, to a printing medium, comprising the steps of:

providing a plurality of first ejecting portions ejecting the at least one kind of ink, and providing a second ejecting portion ejecting the ink composition; and printing a black pixel by controlling to eject ink from one of the plurality of ejecting portions, and to eject the ink composition from the second ejecting portion to a portion where the ink from the one of the plurality of first ejecting portion is to be ejected, one of the ink to be ejected and the ink composition containing a black ink.

Here, a word "ejection portions" can be interpreted as that provided in one printing head and as that provided in respective different printing heads.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed in detail with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to not unnecessarily obscure the present invention.

First Embodiment

Figure 1:
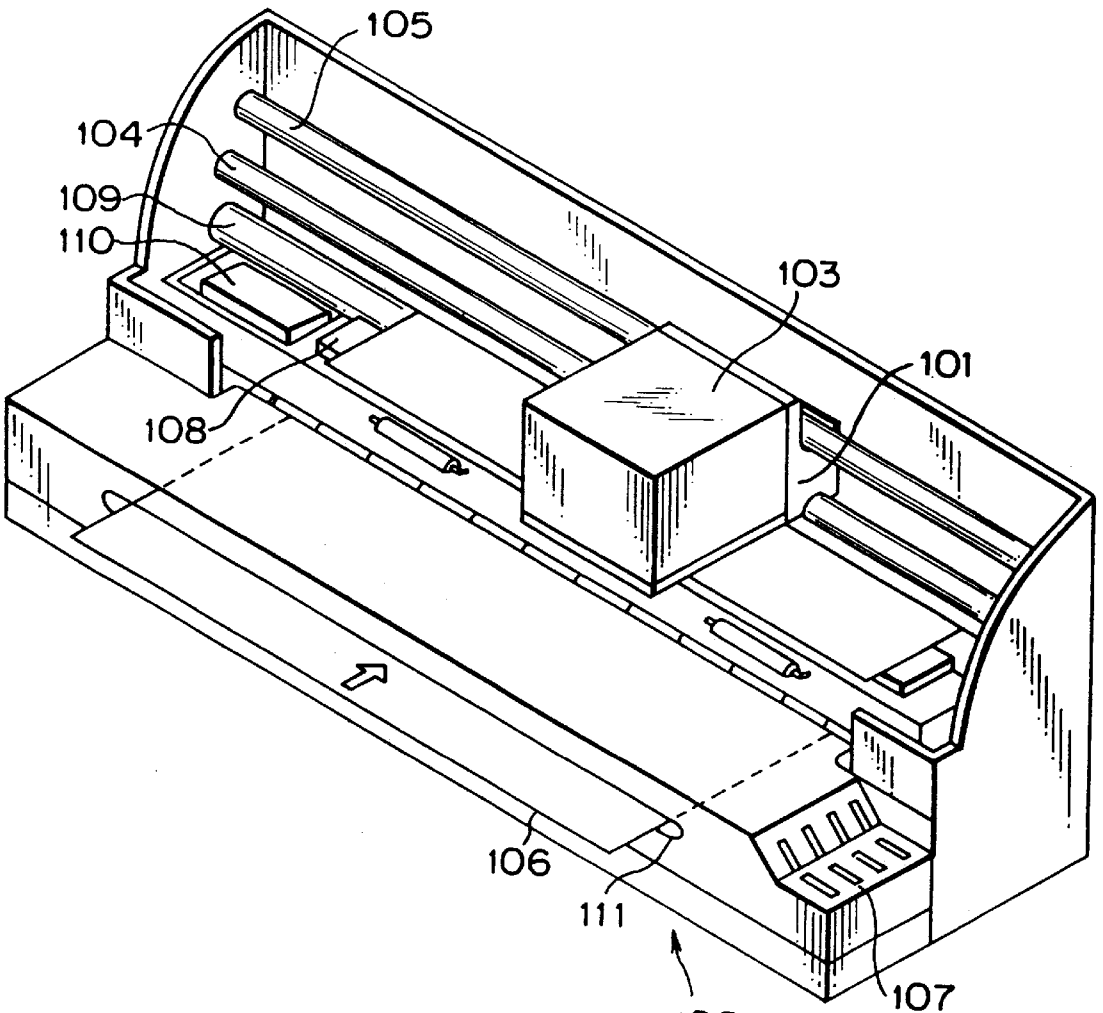
FIG. 1 is a perspective view showing one embodiment of an ink-jet printing apparatus according to the present invention.

FIG. 1 is a perspective view generally showing one embodiment of an ink-jet printing apparatus according to the present invention.

In an ink-jet printing apparatus 100, a carriage 101 slidably engages with two guide shafts 104 and 105 extending in parallel to each other. By this, the carriage 101 can be driven to shift along the guide shafts 104 and 105 by a drive motor and a driving force transmission mechanism (both are not shown) for transmitting the driving force of the drive motor. On the carriage 101, an ink-jet unit 103 having an ink-jet head and an ink tank as an ink container for storing an ink to be used in the head, is mounted.

The ink-jet unit 103 comprises a head for ejecting the ink and a tank as a container for storing an ink to be supplied to the head. Namely, four heads for respectively ejecting a black (Bk), magenta (M) and yellow (Y) inks and a cyan (C) ink containing a component for making coloring agents of the black (Bk), magenta (M) and yellow (Y) inks insoluble or coagulated, and the tanks corresponding to respective heads are mounted on the carriage 101 as the ink-jet unit 103. Each head and the corresponding tank are mutually detachable from each other so that when the ink in the tank is spent out or so forth, only the tank of each ink color can be exchanged independently, as required. Also, it is of course possible to exchange only the head as required. It should be noted that construction for attaching and detaching of the head and the tank is not limited to the shown example, and the head and tank may also be formed integrally.

A paper 106 as a printing medium is inserted through an insertion opening 111 provided at the front end portion of the apparatus, which is finally reversed a feeding direction and fed to the lower portion of the motion range of the carriage 101 by a feed roller 109. By this, from the heads mounted on the carriage 101, inks are ejected on the paper 106 supported on a platen 108 associating with motion of the head to perform printing in a printing region.

As set forth above, by repeating printing in a width corresponding to the width of ejection orifice arrange of the head by shifting of the carriage 101 and feeding of the paper 106, printing is performed on overall paper 106. The paper 106 is then discharged front side of the apparatus.

In a region at the left side end of the motion stroke of the carriage 101, a recovery unit 110 which can be opposed to respective head of the carriage 101 from the lower side, is provided. By this, an operation for capping respective ejection orifices of the ejection heads in non-printing state and sucking ink from ejection orifices of respective heads can be performed. Also, the predetermined position at the left side end is set as a home position of the head.

On the other hand, at the right side end of the apparatus, an operating portion 107 having switches and display elements are provided. The switches are used for turning ON and OFF of a power source of the apparatus and setting of various printing modes, and so forth. The display elements serve for displaying various conditions.

Figure 2:
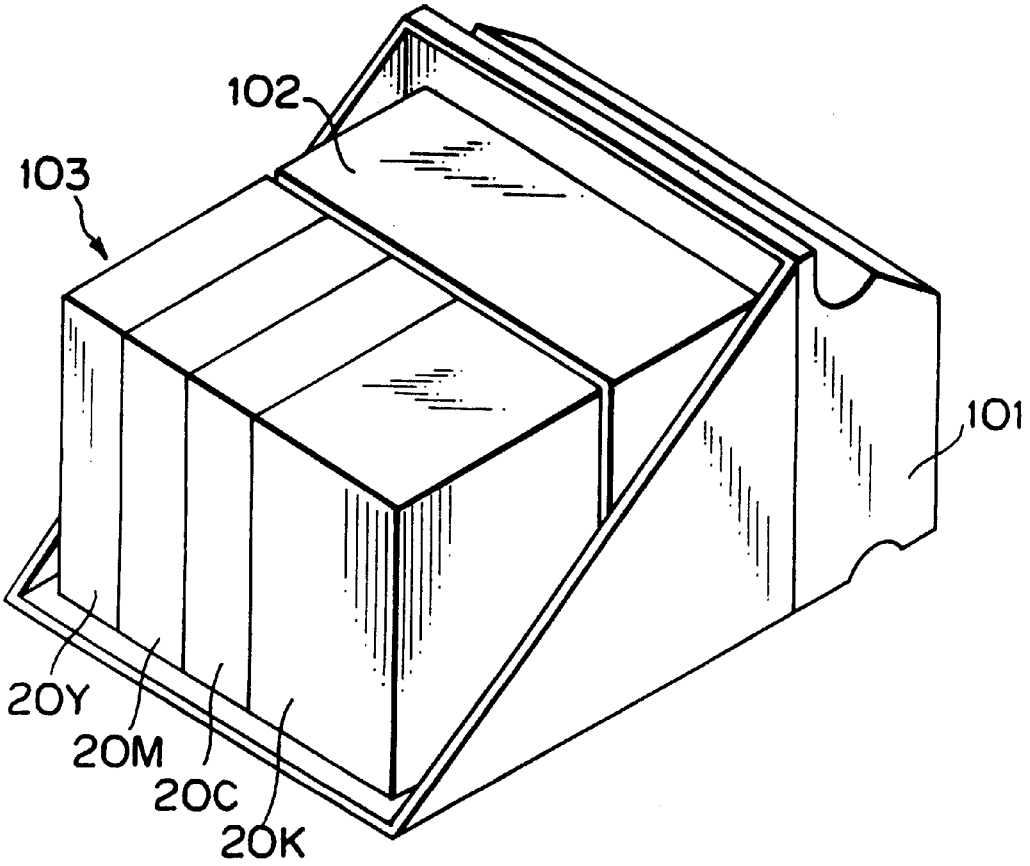
FIG. 2 is a perspective view showing an ink-jet unit in one embodiment of the ink-jet printing apparatus.

FIG. 2 is a general perspective view showing the ink-jet unit 103 explained with respect to FIG. 1. In the shown construction, respective tanks of black, magenta, yellow and cyan color inks can be exchanged independently.

Namely, in order to detachably load each head independently, a head casing 102 and Bk ink tank 20K, C ink tank 20C, M ink tank 20M and Y ink tank 20Y are mounted on the carriage 101. In the head casing 102, heads 30K, 30C, 30M and 30Y (not shown) for respectively ejecting Bk, C, M and Y inks are loaded. Each head has 160 ejection orifices. Through ejection orifices, 40 ng of C, M and Y inks and 80 ng of Bk ink are ejected. Respective tanks are connected to heads via connecting portions and supply inks.

Figure 3:
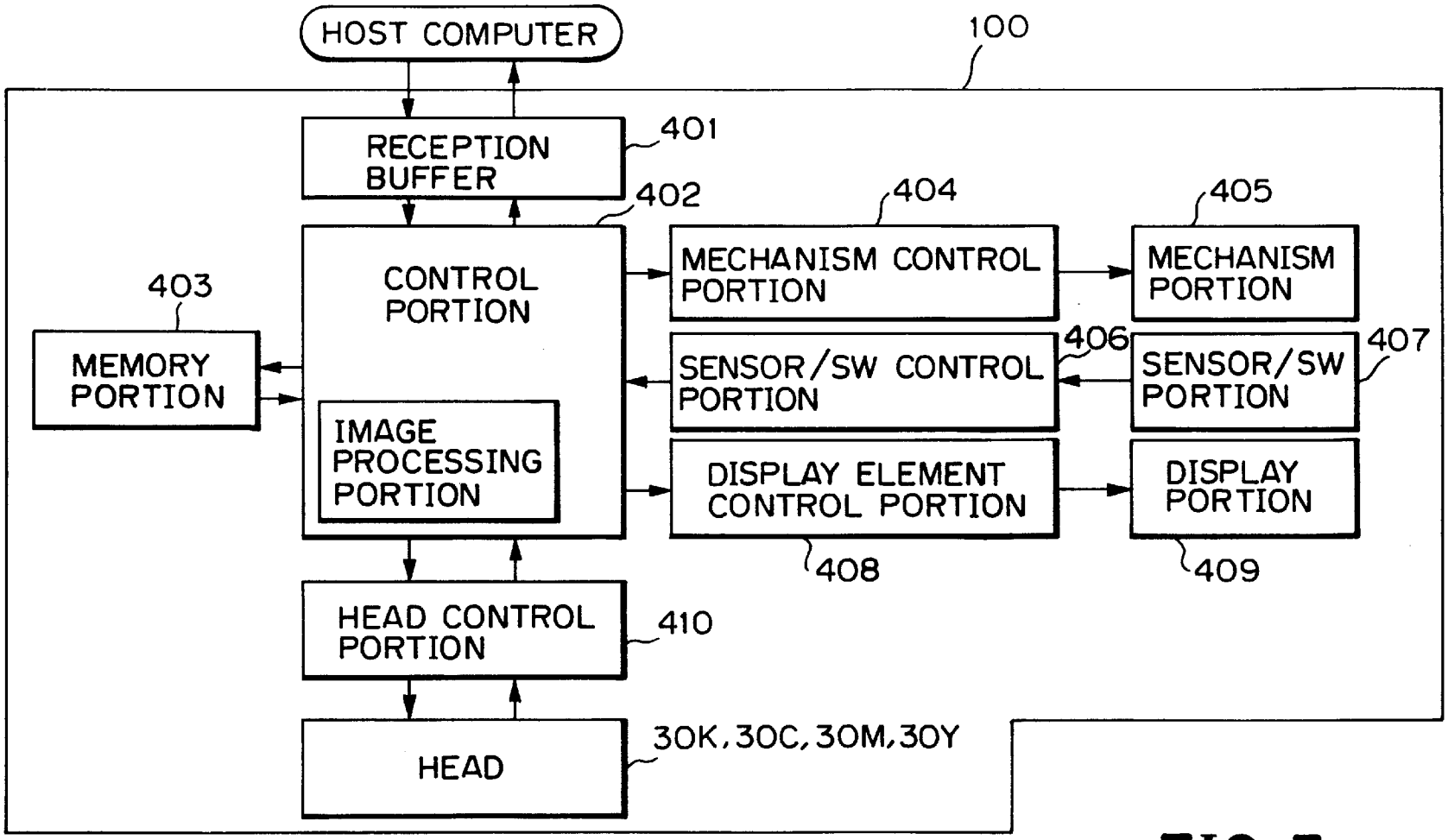
FIG. 3 is a block diagram showing a construction of a control system in one embodiment of the ink-jet printing apparatus.

FIG. 3 is a block diagram showing a construction of a control system of the shown embodiment of the ink-jet printing apparatus.

From a host computer, data of character or image to be printed (hereinafter referred to as image data) is input to a reception buffer 401 of the printing apparatus 100. On the other hand, data verifying if correct data is transmitted or data notifying operating condition of the printing apparatus is transferred from the printing apparatus to the host computer. The data input to the reception buffer 401 is transferred to a memory portion 403 in a form of RAM and temporarily stored therein under control of the control portion 402 having a CPU. A mechanism control portion 404 drives a mechanism portion 405, such as a carriage motor or a line feed motor and so forth as a driving power source for the carriage 101 or the feed roller 109 (both seen from FIG. 1), under a command of the control portion 402. A sensor/SW control portion 406 feeds a signal from a sensor/SW portion 407 constituted of various sensors and SWs (switches), to the control portion 402. A display element control portion 408 controls display of a display element portion 409 constituted of LEDs or liquid crystal display elements of a display panel group. The head control portion 410 independently controls driving of respective heads 30K, 30C, 30M and 30Y according to a command from the control portion 402. On the other hand, the head control portion 410 also reads temperature information or so forth indicative of the conditions of respective heads and transfers the same to the control portion 402.

Figure 4:
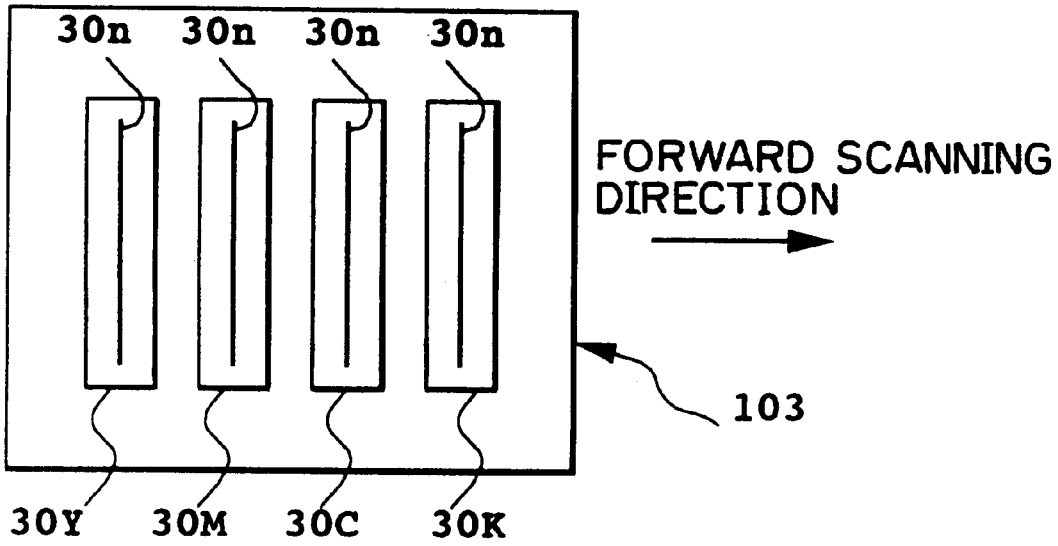
FIG. 4 is a diagrammatic illustration showing a head arrangements for respective color inks in the first embodiment of the invention.

FIG. 4 is a diagrammatic illustration showing respective head arrays in the above-mentioned ink-jet printing apparatus.

As shown in FIG. 4, the ink-jet unit 103 arranges the head 30K for ejecting the black ink (K), the head 30C ejecting cyan ink (C), the head 30M ejecting magenta ink (M) and the head 30Y ejecting the yellow ink (Y), in order.

The head 30C ejects the cyan ink having the following composition, namely cation type cyan ink. (Cyan)

| (Cyan) | |
|---|---|
| diethylene glycol | 10 Wt parts |
| isopropyl alcohol | 2 Wt parts |
| urea | 5 Wt parts |
| acetylenol EH | 1 Wt part |
| C. I. basic blue 75 | 3 Wt parts |
| water | remainder |

On the other hand, heads 30Y, 30M and 30K of yellow (Y), magenta (M) and black (K) inks respectively eject inks having following compositions.

| (Yellow) | |
|---|---|
| diethylene glycol | 10 Wt parts |
| isopropyl alcohol | 2 Wt parts |
| urea | 5 Wt parts |
| acetylenol EH | 1 Wt part |
| C. I. direct yellow 86 | 3 Wt parts |
| water | remainder |
| **(Magenta)** | |
| diethylene glycol | 10 Wt parts |
| isopropyl alcohol | 2 Wt parts |
| urea | 5 Wt parts |
| acetylenol EH | 1 Wt part |
| C. I. acid red 289 | 3 Wt parts |
| water | remainder |
| **(Black)** | |
| thiodiglycol | 5 Wt parts |
| glycerin | 5 Wt parts |
| isopropyl alcohol | 4 Wt parts |
| urea | 5 Wt parts |
| C.I. food black | 3 Wt parts |
| water | remainder |

Here, the cyan ink (C) is a cation type, and other yellow, magenta and black inks are anion type. Then, when the cyan ink contacts or is mixed with other color inks, coloring agent of both colors are made insoluble or coagulated.

In mixing of the cyan ink and other inks as set forth above, in the present invention, as a result of mixing of the cyan and other inks on the printing medium or at a position penetrating the printing medium in a certain magnitude, as the first stage of reaction, a low molecule component or cation type oligomer in the cation type substance contained in the cyan ink, and an anion type compound used in the water soluble dye or pigment ink having anion type group cause association by ionic interaction to separate from solution phase at a moment. As a result, dispersing break-down is caused in the pigment ink to form the coagulated body of the pigment.

Next, as the second stage of reaction, an association body of the above-mentioned dye and low molecule cation type substance or cation type oligomer or coagulated body of the pigment is absorbed by high molecule components included in the processing liquid. Therefore, the coagulated body of the dye or the coagulated body of the pigment caused by association becomes further greater in size to become difficult to penetrate into the gap between the fibers of the printing medium. As a result, only the liquid portion resulting from solid/liquid separation penetrates into the printing paper, whereby both of printing quality and sensibility can be achieved. At the same time, viscosity of the coagulated body formed of the low molecule component of the cation substance or cation type oligomer, anion type dye and cation type substance, or the coagulated body of the pigment is increased so as not to move according to movement of the liquid medium. Therefore, even when the adjacent ink dots are formed with different colors as in formation of a full colors image, the color may not be mixed to each other. Therefore, bleeding is not caused. Also, since the coagulated body is essentially water insoluble, the moisture resistance of the formed image becomes complete. Also, color fastness to light of the formed image can be improved by the shielding effect of the polymer.

A word "insoluble" or "coagulate" used in this specification means a function in which a coloring agent, such as the dye and the pigment, is made insoluble or coagulate, and means a phenomenon only in the first stage, for one example, and phenomenon including both of the first and second stages, in another example.

On the other hand, in implementation of the present invention, since it is unnecessary to use a cation high molecular substance having large molecule or polyvalent metal, or even when it is necessary to use such cation high molecular substance having large molecule or polyvalent metal salt, there are merely used as auxiliary, and the amount of use can be minimized. As a result, a problem of lowering of the color development of dye to be encountered when an attempt is made to obtain the moisture resistant effect using the conventional cation type high molecular substance or polyvalent metal salt, can be avoided as another effect of the present invention.

Figure 5A:
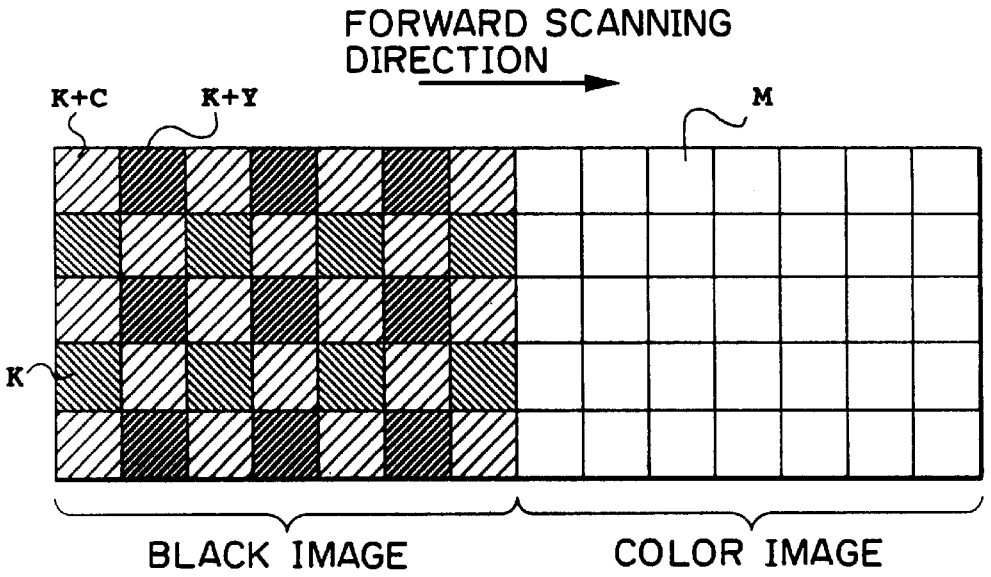
FIGS. 5A to 5C are diagrammatic illustrations showing one example of ejection pattern in the first embodiment.
Figure 5B:
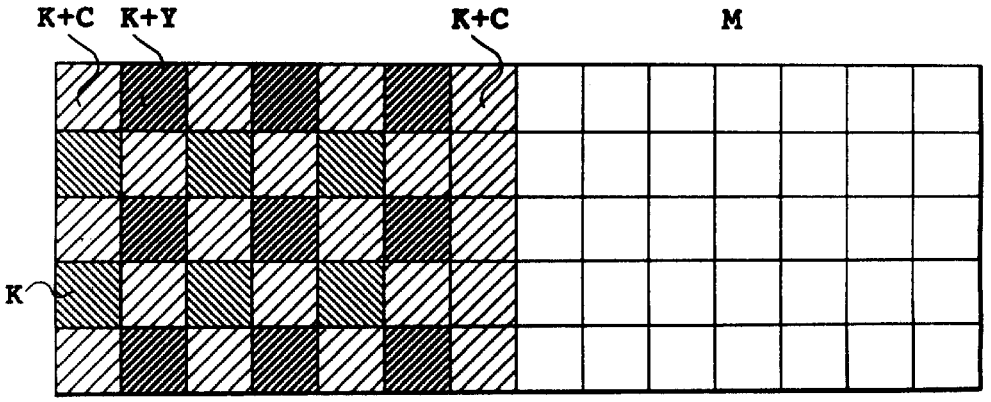
Figure 5C:
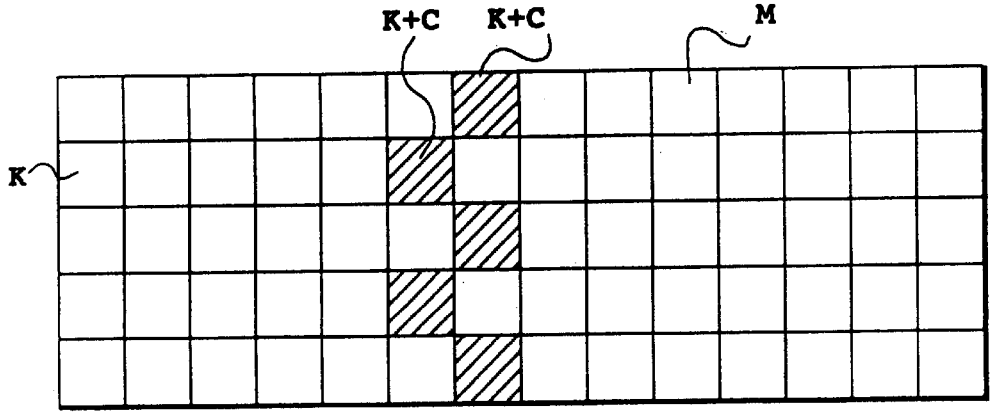

It should be noted that the kind of the printing medium is not specified in implementation of the present invention, and conventionally used plain paper, such as copy paper, bond paper and so forth can be suitably used. Of course, a coated paper specially prepared for ink-jet printing, transparent film for OHP and so forth may also be used suitably. Also, general wood free paper, glossy paper and so forth may also used suitably, FIGS. 5A to 5C are illustrations for explaining the process of the shown embodiment with respect to printing data, in which the black image and color image are present adjacent to each other, and shows pixels arranged in a form of matrix in a scanning direction of the heads and a direction of the arrangement of the ejection orifices of these heads. In concrete, there is shown a printing process in the case where the color image is magenta. The discussion will be given with respect to this.

At first, upon forward scanning (see FIG. 4) of the ink-jet unit 103, in a printing region of the black image, a black ink is ejected from respective ejection orifices 30*n* of the head 30K. Next, from the head 30C, the cyan ink is ejected to the pixels (the pixels indicated by K+C) of the pattern shown in FIG. 5A. By this, the black ink and the cyan ink are contacted and mixed on the pixels. Then, on each of these pixels, the black ink and the cyan ink causes a reaction to make the dye insoluble or coagulated. Also, through respective ejection orifices 30*n* of the head 30Y, the yellow ink is ejected to the pixels (the pixels indicated by K+Y) in the pattern shown in FIG. 5A. It should be noted that ejection of the yellow ink is performed for adjustment of tone of the black image. Accordingly, if necessary for adjustment of tone, magenta ink may also be ejected. More specifically, when the cation type cyan ink is combined with the anion type black ink, the color thereof becomes blue black and does not become satisfactorily black in the color taste. Then, overall blackness can be increased by forming pixels with combining yellow ink with the black ink in the vicinity of the pixels in which the cation type cyan ink is combined with the anion type black ink. Similarly, in the case where the yellow ink contains the cation type component, the combination of the yellow ink and the black ink may not provide satisfactory blackness. Therefore, by employing another combination of the black ink and other color ink, i.e. magenta ink or cyan ink in the adjacent pixels, overall blackness can be increased.

When scanning of the ink-jet unit 103 transits from a black image region to a color image region, magenta ink is ejected to all of the pixels. By the foregoing scan in the forward direction, the black ink is ejected for all of the pixels in the black image region. On the other hand, the C ink is ejected according to the pattern shown in FIG. 5A. Also, in the color image region, M ink is ejected.

In the black image region in the reverse scanning of respective heads, at first, the yellow ink is ejected from the head 30Y along the pattern shown in FIG. 5A. It should be noted that from the head 30M, the magenta ink is ejected for all of the pixels in the color image region before moving into the black image region. In the black image region, the cyan ink is ejected from the head 30C according to the pattern shown in FIG. 5A again, and from the head 30K, the black ink is ejected to all of the pixels of the black image region. At this time, the black ink in the black image region reacts with the cyan ink similarly to that set forth above. Also, in the pixels to which the yellow ink is ejected and the pixels to which only black ink is ejected, the dyes are made insoluble by the extra amount of cyan ink present in adjacent pixels and flowing into these pixels.

As set forth above, according to the shown embodiment, with arranging the head 30K ejecting the black ink and the head 30C ejecting the cyan ink, the cyan ink is ejected immediately after ejection of the black ink. Therefore, the dye in the black ink is made insoluble or coagulated before the black ink penetrates into the printing paper. Thus, the dye of the black ink can be held on the surface at a great amount so that the density of the black image is increased. Also, bleeding at the border portion of the black image and the color image can be successfully prevented.

The ejection pattern of the cyan ink and the yellow ink with respect to the black region is not limited to the pattern illustrated in FIG. 5A but can be the patterns as illustrated in FIGS. 5B and 5C. FIG. 5B shows the example in which bleeding of the ink at the border is prevented by ejecting the cyan ink at a greater amount only at the border portion. On the other hand, FIG. 5C shows the example by ejecting the cyan ink only at a part of the border. Either case may be selected depending upon the characteristics of the ink and the printing speed.

Further, in the case that the color tones of the black image vary depending upon the direction of the scannings, the tones can be adjusted by varying an ejection pattern of the cyan ink or the yellow ink.

Figure 6:
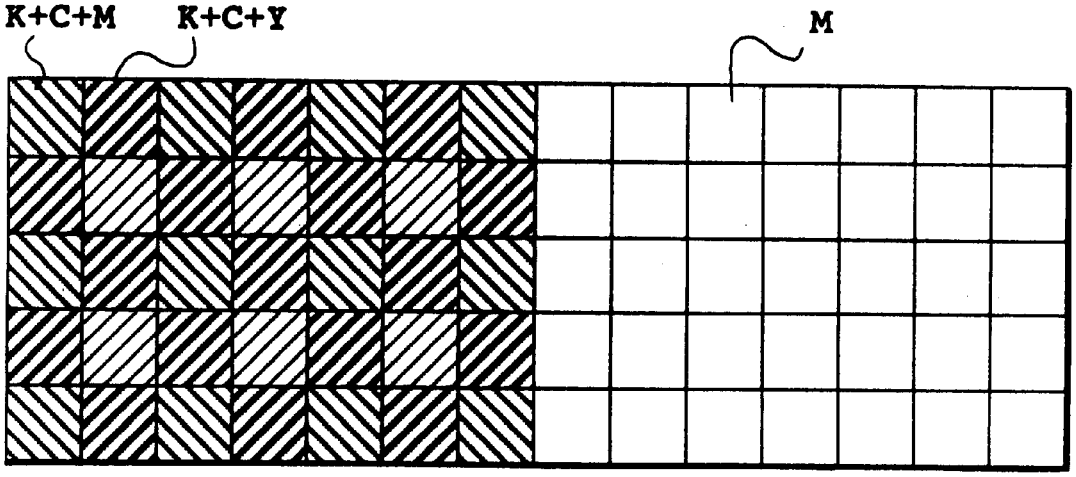
FIG. 6 is a diagrammatic illustration showing an ejection pattern in a modification of the first embodiment.

FIG. 6 is an explanatory illustration showing a modification of the ejection pattern shown in FIGS. 5A to 5C.

The pattern shown in FIG. 6 is to eject the cation type cyan ink and the black ink for all of the pixels in the black image region. On the other hand, the yellow ink and magenta ink are ejected in an alternate pattern to each other. By this, in the black image region, the portion where the cyan ink is ejected is increased to improve moisture resistance of the printed image, correspondingly.

Second Embodiment

In the embodiment discussed hereinafter, when the black image is printed, several modifications where the order of ejection of the ink containing the cation type component is varied.

First Modification

Figure 7A:
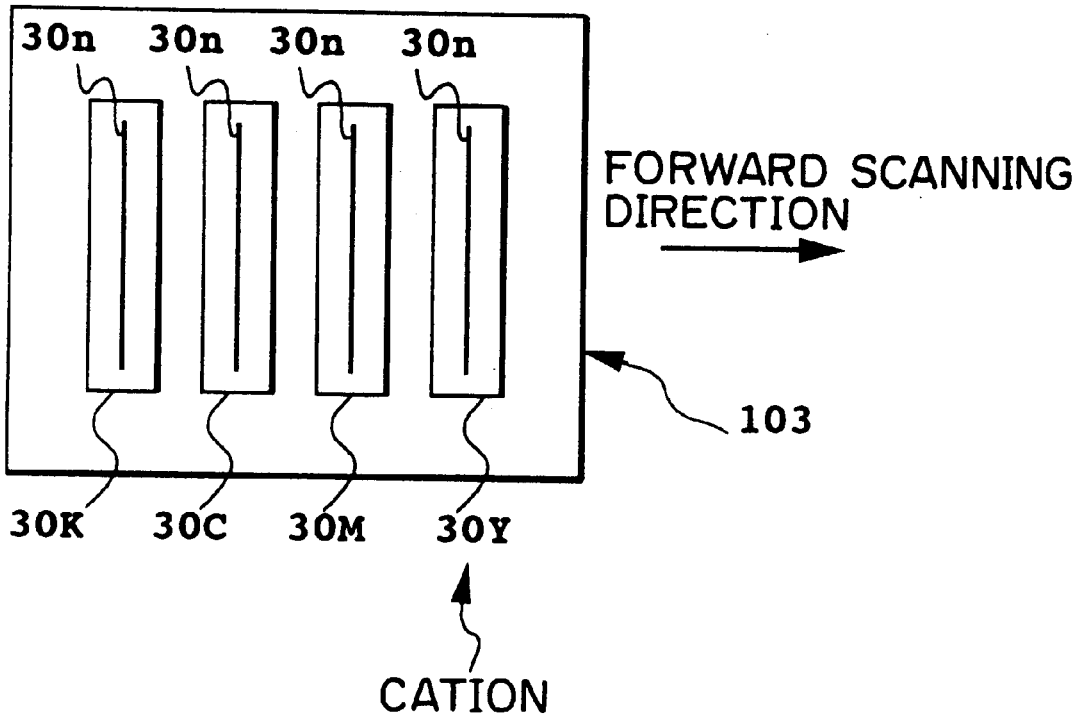
FIGS. 7A and 7B are diagrammatic illustrations showing a head arrangement of one modification of the second embodiment of the ink-jet printing apparatus according to the invention, and state of ink permeation.

FIG. 7A shows the case where the Y ink is the cation type ink. In this case, respective heads are arranged in the order of 30Y, 30M, 30C and 30K.

Figure 7B:
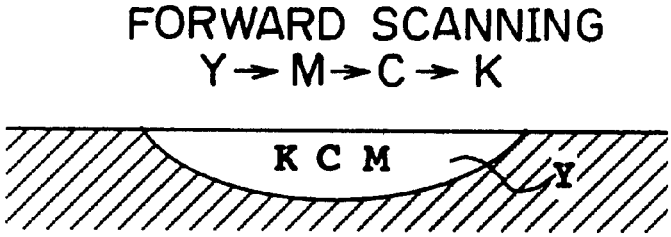

FIG. 7B is an illustration showing a state of respective inks in the printing medium when printed in the forward scanning direction (see FIG. 7A).

The compositions of the inks used in this modification are as follows:

| | |
|---|---|
| (Black) | |
| thiodiglycol | 5 Wt parts |
| glycerin | 5 Wt parts |
| isopropyl alcohol | 4 Wt parts |
| urea | 5 Wt parts |
| C.I. food black | 3 Wt parts |
| water | remainder |
| (Yellow) | |
| glycerin | 10 Wt parts |
| thiodiglycol | 10 Wt parts |
| polyallylamine | 3 Wt parts |
| cation activator (Sanyo Kasei K.K. G-50) | 0.5 Wt parts |
| acetylenol EH | 0.25 Wt parts |
| C. I. basic yellow-21 | 1.6 Wt parts |
| water | remainder |
| (Magenta) | |
| diethylene glycol | 10 Wt parts |
| isopropyl alcohol | 2 Wt parts |
| urea | 5 Wt parts |
| acetylenol EH | 1 Wt part |
| C. I. acid red 289 | 2.1 Wt parts |
| water | remainder |
| (Cyan) | |
| diethylene glycol | 10 Wt parts |
| isopropyl alcohol | 2 Wt parts |
| urea | 5 Wt parts |
| acetylenol EH | 1 Wt part |
| C. I. basic blue-199 | 3 Wt parts |
| water | remainder |

ejection amount of respective color inks: 25 pl

In the composition as set forth above, the concentration of the dyes of Y, M, C inks are adjusted so that the image formed by printing Y, M, C at 100% duty may become substantially black. It should be noted, however, that in view of reliability, the concentration of the dyes in respective inks should not exceed 3.5%.

With the embodiment set forth above, as shown in FIG. 7B, the ink Y and the ink M are contacted to each other to become insoluble or coagulated to block penetration of coloring agent of other inks into the printing medium. Therefore, the coloring agent of Y, M, C, K remain at the surface of the printing medium in a large amount to achieve high color density.

As a result, when one way printing is performed, improvement of density and color taste can be successfully achieved. Also, since the Y ink as the cation type ink is located at an end of the head array, influence to other inks by splashing of ink upon wiping by means of a blade or so forth can be decreased.

Second Modification

Figure 8A:
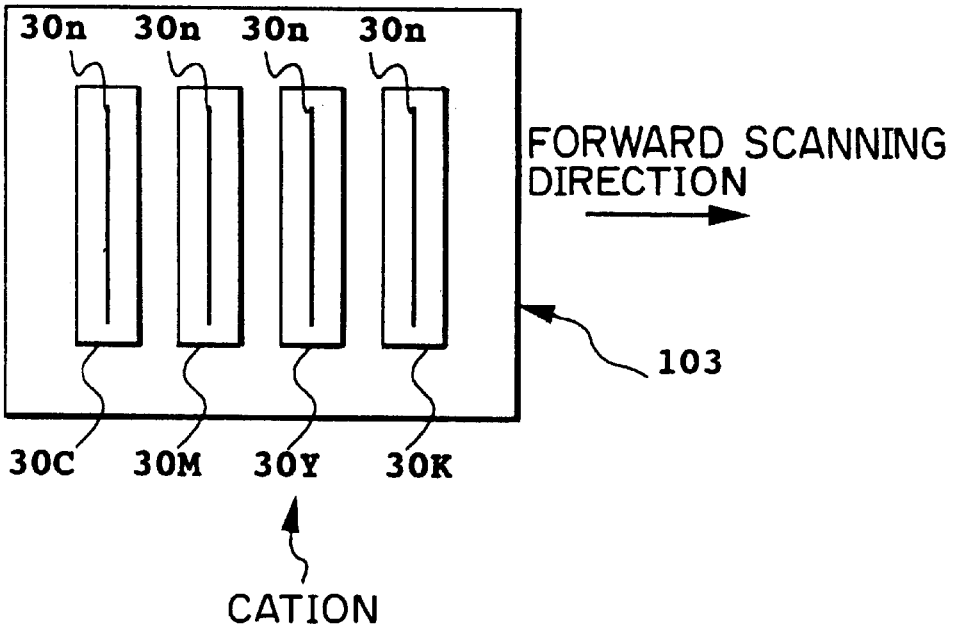
FIGS. 8A, 8B and 8C are diagrammatic illustrations showing head arrangement and a state of ink permeation in another modification of the second embodiment of the invention.

FIG. 8A shows a second modification, in which the head array is arranged in the order of 30K, 30Y, 30M and 30C. Among the inks ejected by these heads, the yellow ink ejected through the ejection orifices 30*n* of the head 30Y contains the cation type component which reacts with the dyes of other inks.

Figure 8B:
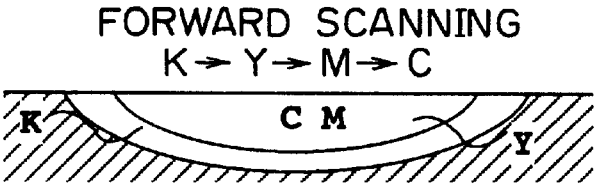
Figure 8C:
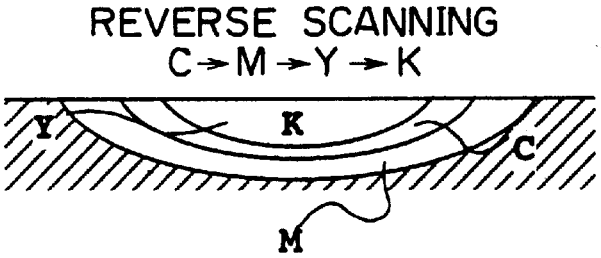

FIGS. 8B and 8C are diagrammatic illustrations showing a state of permeation of respective inks ejected during forward scanning and reverse scanning.

As shown in FIGS. 8B and 8C, in the forward printing, the magenta and cyan ejected subsequent to the Y ink having cation type component will remain on the surface of the printing medium. In this case, since the cyan ink having low brightness is ejected at final order, the color close to black can be certainly obtained to suppress variation of tone of the black. In addition, since the black ink is ejected subsequent to ejection of the Y ink, the dye of the black ink may remain on the surface of the printing medium to make the density of the black image higher.

As set forth above, with the shown modification, basically, the density of the black image can be made higher. In addition, tone variation in forward and reverse scanning can be reduced.

In the shown modification, respective inks employed in the first modification are employed. Then, the following experiments were performed.

Experiment 1

By setting the ejection amount of respective color at 25 pl, printing was performed at 100% duty in respective color. As a result, better density was obtained than the foregoing first modification.

Experiment 2

By setting the ejection amount of respective color at 25 pl, printing was performed at 100% duty of Bk and 50% duty of Y, M and C. As a result, influence of Y, M and C become smaller to obtain a better result than the experiment 1.

Experiment 3

By setting the ejection amount of Bk at 25 pl, Y, M, C respective at 13 pl, printing was performed at 100% duty in respective color. As a result, better density was obtained than the foregoing Experiment 2.

As set forth above, the shown embodiment, even when the total amount of the inks other than black to be ejected on the printing medium is halved, satisfactory result of printing can be obtained.

Third Modification

Figure 9A:
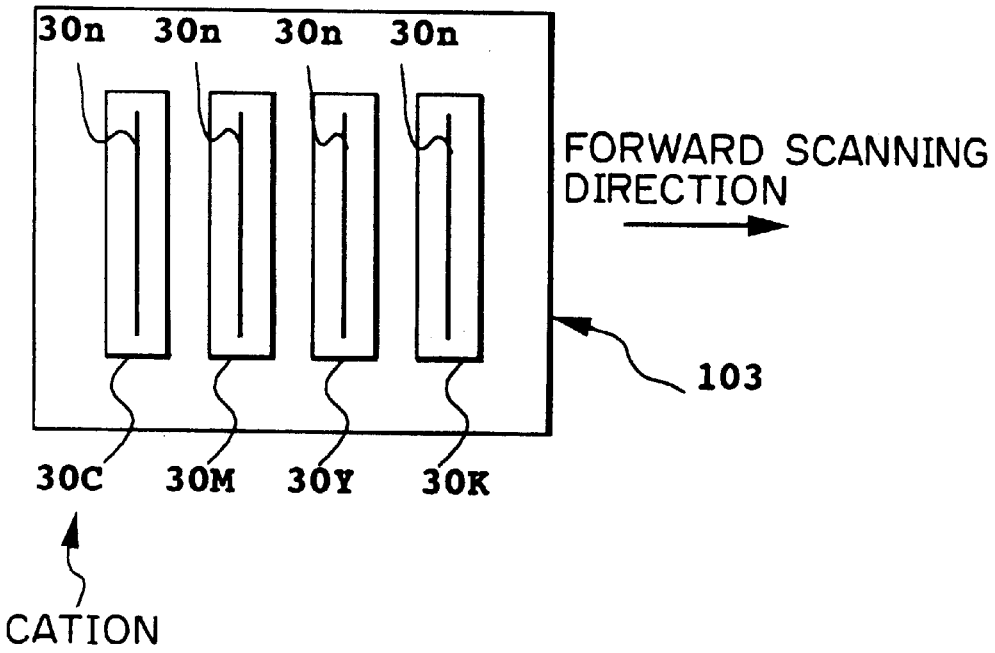
FIGS. 9A, 9B and 9C are diagrammatic illustrations showing head arrangement and a state of ink permeation in a further modification of the second embodiment of the invention.

FIG. 9A shows the third modification of head arrangement, in which the heads are arranged in the order of 30K, 30Y, 30M, 30C. Among these, the cyan ink to be ejected through respective ejection orifices 30*n* of the head 30C contains the cation component.

Figure 9B:
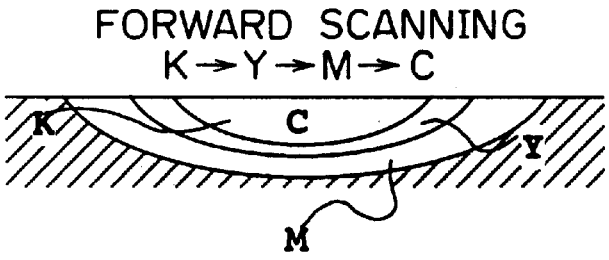
Figure 9C:
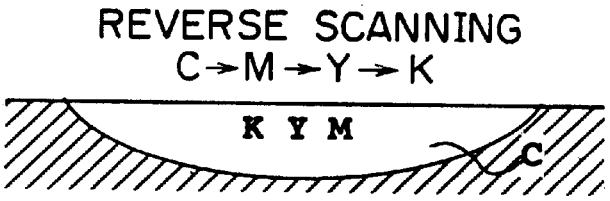

FIGS. 9B and 9C are diagrammatic illustration showing a state of permeation of respective inks ejected by forward scanning and reverse scanning of respective heads to the printing medium.

As shown in FIGS. 9A to 9C, in the forward scanning, the black ink (K) is ejected at first, with the subsequently ejected ink permeation penetrating into the lower side of K. As a result, the residual amount of the dye of K on the surface of the printing medium becomes relatively large. On the other hand, in the reverse scanning, since the cyan ink containing the cation component is ejected at first, the dyes of the inks subsequently ejected are maintained on the surface of the printing medium.

As set forth, with the shown embodiment, in addition to improvement of density of the black image, tone variation in reciprocating printing can be reduced. Also, as set forth with respect to the first modification, by arranging the head ejecting the ink containing cation component at the end of the arrangement of the heads, the construction of the recovery system can be simplified to prove realizability.

The compositions of the inks used in the shown modification are as follows:

| | |
|---|---|
| (Black: K) | |
| thiodiglycol | 5 Wt parts |
| glycerin | 5 Wt parts |
| isopropyl alcohol | 4 Wt parts |
| urea | 5 Wt parts |
| C. I. food black | 3 Wt parts |
| water | remainder |
| (Yellow: Y) | |
| diethylene glycol | 10 Wt parts |
| isopropyl alcohol | 2 Wt parts |
| urea | 5 Wt parts |
| acetylenol EH | 1 Wt parts |
| C. I. direct yellow-86 | 2.5 Wt parts |
| water | remainder |
| (Magenta: M) | |
| diethylene glycol | 10 Wt parts |
| isopropyl alcohol | 2 Wt parts |
| urea | 5 Wt parts |
| acetylenol EH | 1 Wt part |
| C. I. acid red 289 | 3.5 Wt parts |
| water | remainder |
| (Cyan: C) | |
| glycerin | 10 Wt parts |
| thiodiglycol | 2 Wt parts |
| polyallylamine | 5 Wt parts |
| cation activator | 1 Wt parts |
| (Sanyo Kesei K.K. G-50) | |
| acetylenol EH | 0.25 Wt part |
| C. I. basic blue-199 | 3.5 Wt parts |
| water | remainder |

Here, the dye concentration is not preferable to exceed 2% in view of reliability. Under the premise of this condition, if the dye concentrations of respective of Y, M, C are adjusted so that a substantially black image can be obtained by printing in overlapping manner at 100% duty, the concentration of the dyes of M and Y have to be lowered in significant level. As a result, the printing density of M and Y can be lowered. Therefore, without lowering the dye concentrations of M and Y, adjustment is made by thinning the image pattern.

For example, by setting the ejection amounts of respective color at 25 pl, and setting the duty of Bk at 100% and thinning the image patterns of Y, M, C at the duty of 25%, the color fluctuation in reciprocating printing can be reduced to obtain satisfactory printing quality.

Fourth Modification

Figure 10:
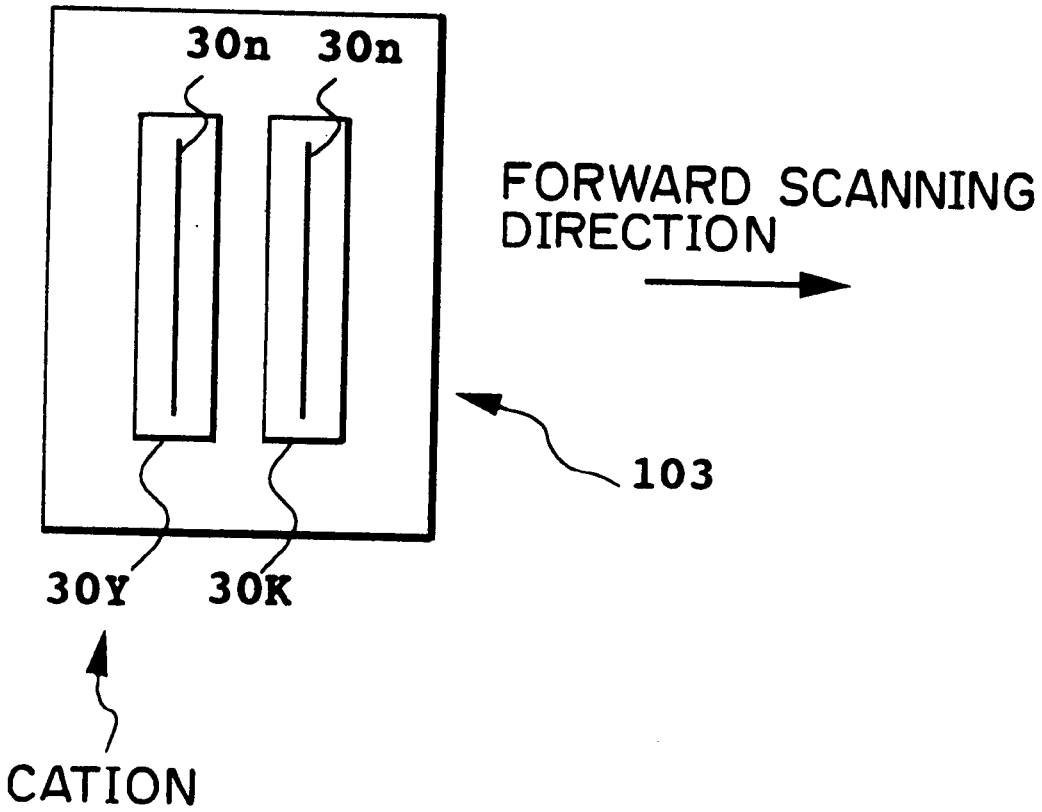
FIG. 10 is a diagrammatic illustration showing a head arrangement in another modification of the second embodiment of the invention.

FIG. 10 shows a head arrangement in the shown modification, in which the respective heads are arranged in the order of 30K, 30Y. Namely, the head 30K is adapted to eject a bluish black ink formed by adding dyes of cyan and magenta to the pure black ink, and the head 30Y ejects the yellow ink containing the cation component.

With the construction set forth above, since the total amount of the ink to be ejected onto the printing medium can be reduced, it can prevent so-called thickening of the character in the line image, such as a character, or so forth. Also, since the relative ejection amount of the ink other than the cation type ink can be reduced, the dye can be made insoluable or coagulated satisfactorily to improve moisture resistance.

The compositions of the inks used in the shown modification are as follows:

| | |
|---|---|
| (Black: K) | |
| thiodiglycol | 5 Wt parts |
| glycerin | 5 Wt parts |
| isopropyl alcohol | 4 Wt parts |
| urea | 5 Wt parts |
| C. I. food black | 1.8 Wt parts |
| C. I. acid red 289 | 0.6 Wt parts |
| C. I. direct blue | 0.6 Wt parts |
| water | remainder |
| (Yellow: Y) | |
| glycerin | 10 Wt parts |
| thiodiglycol | 10 Wt parts |
| polyallylamine | 3 Wt parts |
| cation activator | 0.5 Wt parts |
| (Sanyo Kasei K. K. G-50) | |
| acetylenol EH | 0.25 Wt parts |
| C. I. basic yellow-21 | 2 Wt parts |
| water | remainder |
| (Magenta: M) | |
| C. I. acid read-289 | |
| (Cyan: C) | |
| C.I. direct blue-100 | |

Employing the foregoing embodiment, ejection was performed at 40 pl of Bk and at 25 pl of Y. The Bk and Y were printed in overlapping manner at 100% of duty, and substantially satisfactory result of printing could be obtained.

Fifth Modification

Figure 11:
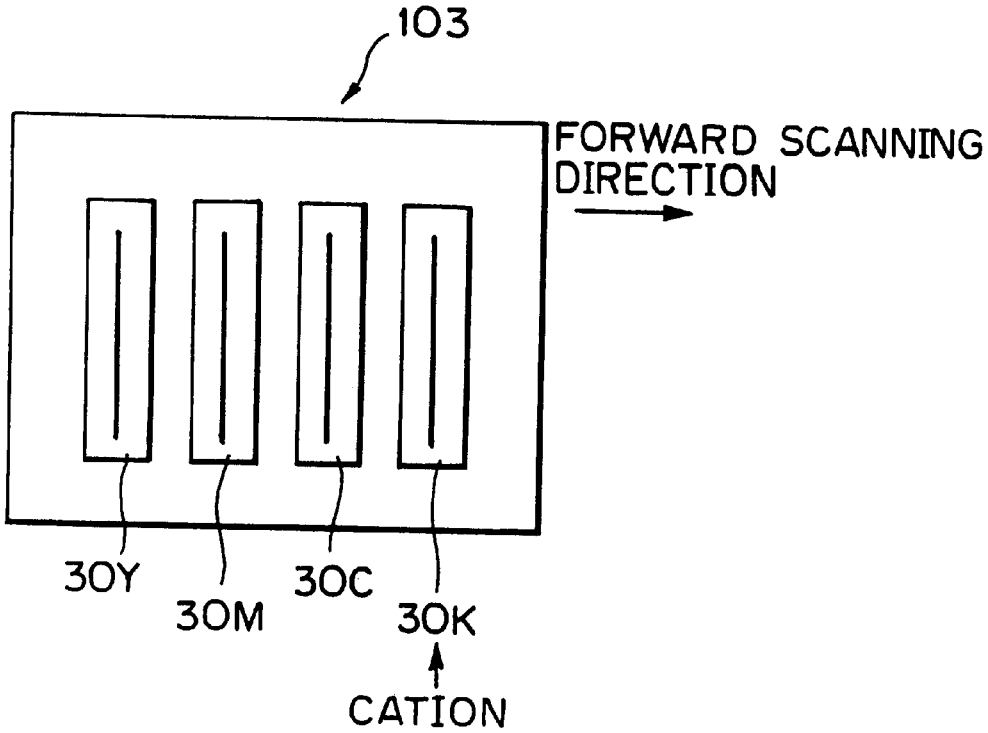
FIG. 11 is a diagrammatic illustration showing a head arrangement in further modification of the second embodiment of the invention.

FIG. 11 is a diagrammatic illustration showing the fifth modification. In the shown modification, the heads are arranged in the order of 30Y, 30M, 30C and 30K. The head 30K ejects the black ink with the cation component.

With the construction set forth above, when the black image is printed by reciprocal printing the black ink (K) and the cyan ink (C) are used. In the forward scanning, the inks are ejected in the order of K and then C, to the contrary, in the reverse scanning, the inks are ejected in the order of C and then K. Here, the ejection amount of the black ink (K) is 40 pl and the ejection amounts of the cyan ink (C), the magenta ink (M) and the yellow ink (Y) are respectively 15 pl.

As set forth above, when the black image is printed by overlapping ejection of only cyan ink (C) over the black ink, the density of the black image can be increased. In conjunction therewith, it becomes possible to reduce the number and amount of the color inks other than black for preventing fluctuation of the tone.

The composition of the inks used in the shown modification are as follows.

| | |
|---|---|
| (Black: K) | |
| thiodiglycol | 10 Wt parts |
| glycerin | 10 Wt parts |
| isopropyl alcohol | 4 Wt parts |
| Polyallylamine | 3 Wt parts |
| (average molecule by weight 1000) | |
| Kayacek Black (Nihon Kayaku K. K.) | 2.5 Wt Parts |
| water | remainder |
| (Cyan: C) | |
| diethylene glycol | 10 Wt parts |
| isopropyl alcohol | 2 wt parts |
| urea | 5 Wt parts |
| acetylenol EH | 1 Wt parts |

-continued

| | |
|---|---|
| C. I. direct blue-199 | 3.5 Wt parts |
| water | remainder |
| (Yellow: Y) | |
| diethylene glycol | 10 Wt parts |
| isopropyl alcohol | 2 Wt parts |
| urea | 5 Wt parts |
| acetylenol EH | 1 Wt parts |
| C. I. direct yellow-86 | 5.5 Wt parts |
| water | remainder |
| (Magenta: M) | |
| diethylene glycol | 10 Wt parts |
| isopropyl alcohol | 2 Wt parts |
| urea | 5 Wt parts |
| acetylenol EH | 1 Wt part |
| C. I. acid red 289 | 2.1 Wt parts |
| water | remainder |

As shown in the foregoing composition, the black ink contains polyallylamine as a component. What is coupled with the polyallylamine of cation type is the anion dye. Coupling between the cation dye and the anion dye is relatively weak. In view of moisture resistance, color cation is more effective. However, since the color anion and polyallylamine are coupled, it is effective for increasing density and as a measure for bleeding.

Sixth Modification

Figure 12:
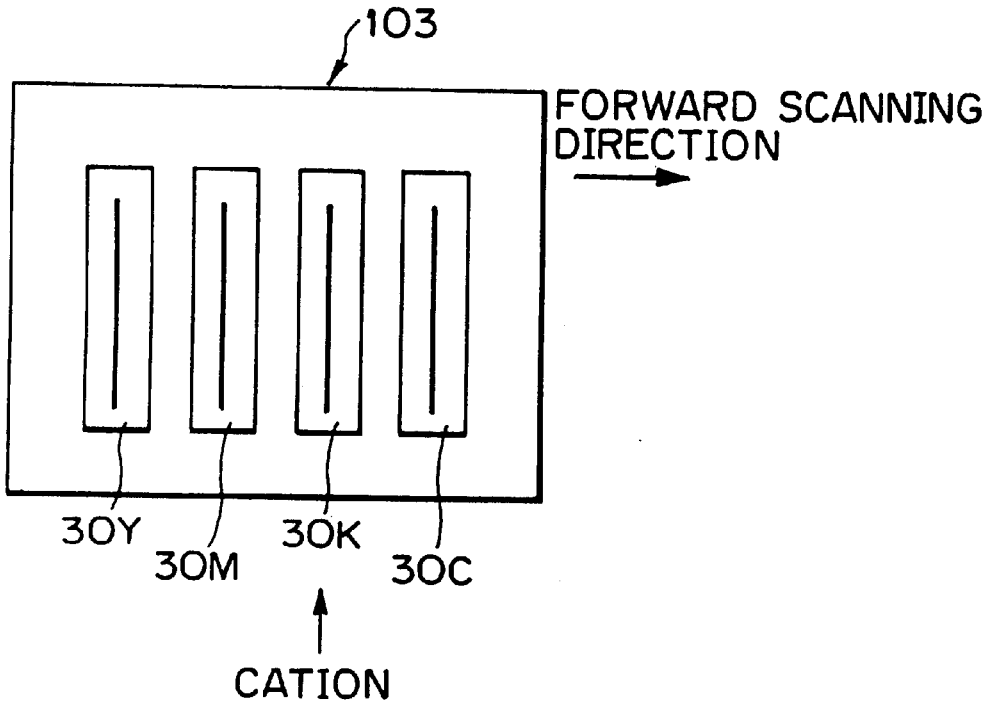
FIG. 12 is a diagrammatic illustration showing a head arrangement in a still further modification of the second embodiment of the invention.

FIG. 12 is a diagrammatic illustration of the sixth embodiment of the ink-jet unit.

In the shown modification, the ink jet heads are arranged in the order of 30C, 30K, 30M, 30Y. The black ink (K) to be ejected from the head 30K contains the cation component. In the shown construction, when the black image is printed by reciprocating printing, ejection is performed in the order of cyan ink (C) and the black ink (K) in the forward scanning, and ejection is performed in the order of magenta (M) ink and the black ink (K) in the reverse scanning. In the shown embodiment, the ejection amounts of the inks are substantially the same as those in the foregoing fifth embodiment.

With the construction set forth above, the density of the black image can be increased, and in conjunction therewith, fluctuation of the color in the reciprocal printing can be suppressed, since a polymer for coupling with the cation type block ink in the black ink so as to prevent the tone from being fluctuated. Further, according to the order of ejection in the shown modification, since the black dye of the cation type remains on the surface of the printing medium, the influence of the undercoat can be successfully avoided.

It should be noted that the compositions of the inks in the shown modification are similar to the foregoing fifth embodiment. The different point is that 0.5 Wt parts of stin-acrylic acid copolymer (average molecule by weight is 10000) is employed as the polymer in the cyan ink.

Seventh Modification

Figure 13A:
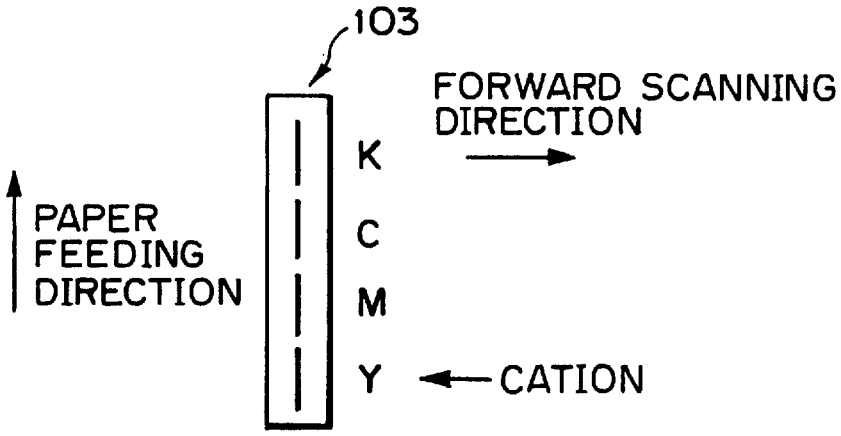
FIGS. 13A, 13B and 13C are diagrammatic illustrations showing a head arrangement in yet further modification of the second embodiment of the invention.
Figure 13B:
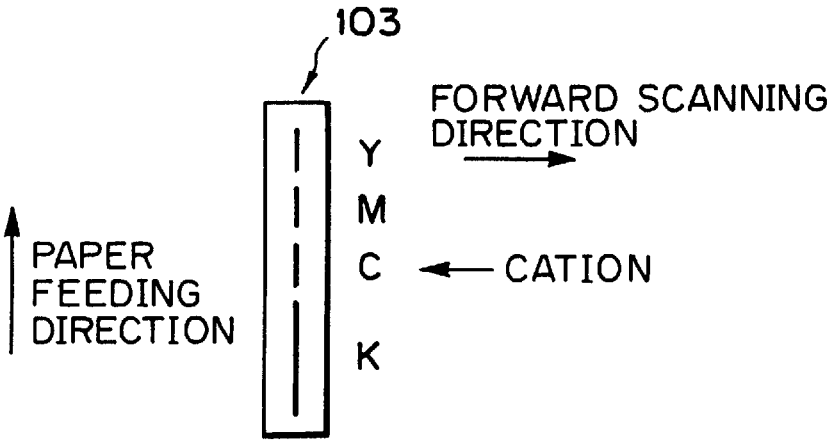
Figure 13C:
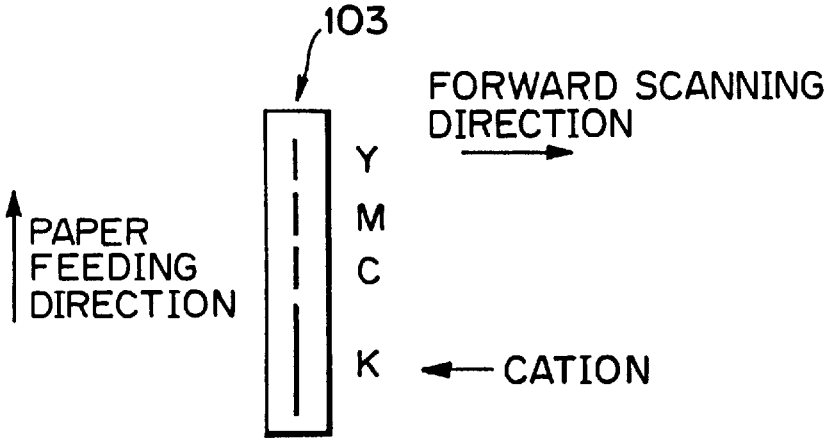

FIG. 13A to 13C are diagrammatic illustrations showing the seventh modification of the ink-jet unit.

As shown in FIGS. 13A to 13C, the heads for respective color inks are arranged vertically, i.e., in the feeding direction of the printing medium (see FIG. 1). Also, these heads are formed integrally.

By employing such construction, not only in case of printing of the black image, but also in case of printing in any color, the order of ejection is not varied between respective colors in forward and reverse printing. Therefore, no color fluctuation will be caused.

The construction of the head shown in FIG. 13A includes thirty-two in number of ejection orifices for each color of the head. A space between adjacent head positions corresponds to eight ejection orifice pitches. The ejection amount in each head is 25 pl. In this construction, by performing printing employing the inks the same as those employed in the first modification in the order of Y, M, C, K, density of black image can be increased by making the black dye insoluble or coagulated. Also, the moisture resistance of the printed image can be improved. Furthermore, when the black image is printed by overlapping all inks in addition to the black ink, since the cation type ink (Y in the shown case) is ejected at the earliest timing, this is preferred in viewpoint of making dye insoluble.

The construction shown in FIG. 13B has twenty-four ejection orifices for each head for Y, M, C. The head for the black ink (K) has sixty-four ejection orifices. Also, the ejection amount of the heads of Y, M, C is 15 pl and the ejection amount of the black ink (K) is also 15 pl.

In the shown construction, the inks have the same compositions to the foregoing third modification. While the black image becomes somewhat bluish, the ink amount for printing the black image can be reduced. Also, when the black image is printed, ejection is performed in the order of black ink (K) and then cation type cyan ink (C). In this case, the color taste can be improved in comparison with the case where the cation type yellow is overlapped on the black ink (K). Also, by selecting the ejection order so that the order of ejection of the cyan (C) is determined to be adjacent to the ejection order of the black (K), bleeding between the black and the cyan can be successfully avoided. Also, the bleeding between the cyan, magenta and yellow can be avoided since the interval of ejections becomes longer than that in the case where the heads are arranged in the lateral direction.

The head shown in FIG. 13C is similar to the head shown in FIG. 13B, and the different point is that the black ink contains the cation component.

In the construction set forth above, when the black image is printed by means of the inks employed in the fifth embodiment, the ejection is performed in the order of black ink (K), the cyan ink (C). By this, the density of the black image can be increased, Also, it becomes possible to eliminate bleeding between respective other colors.

Third Embodiment

The shown embodiment provides the ink-jet printing apparatus for operating in a black enhanced printing mode utilizing any one of the foregoing embodiments for increasing density of the black image and a normal printing mode.

Figure 14:
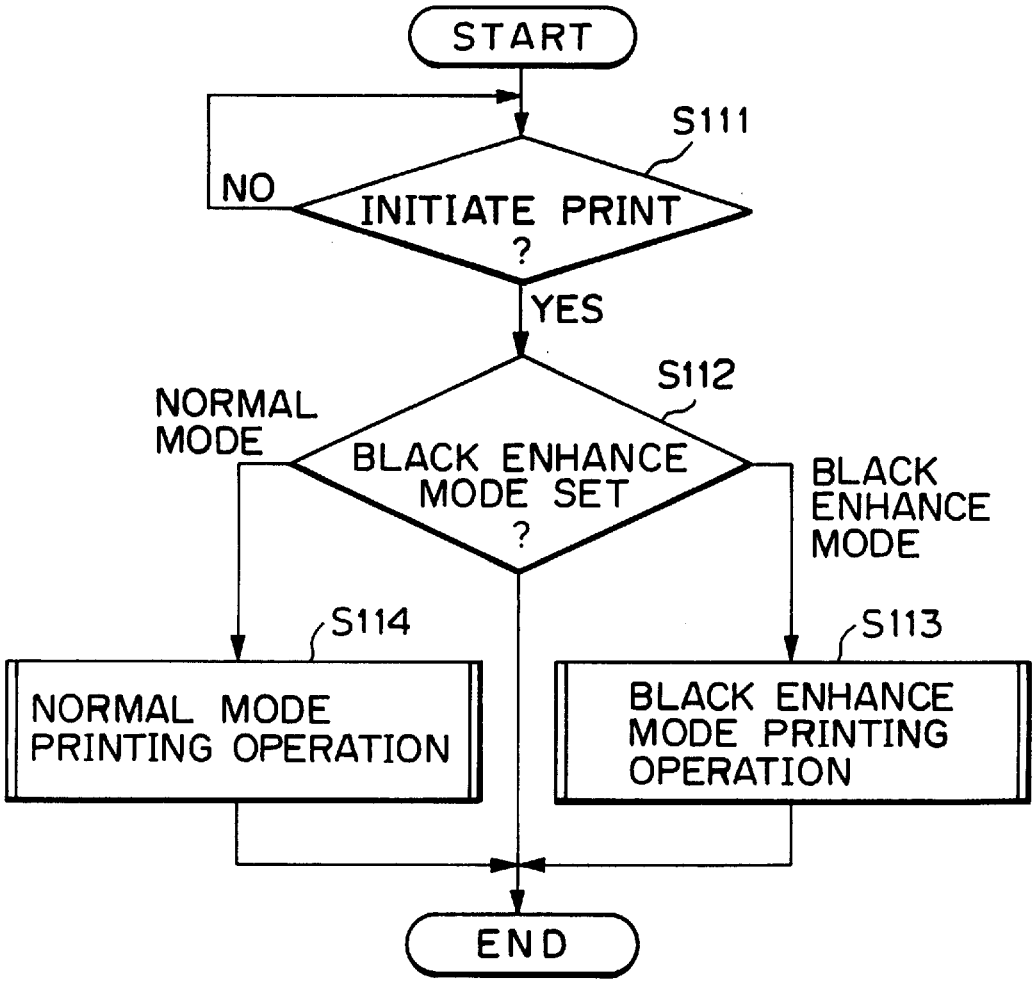
FIG. 14 is a flowchart showing a process of printing operation in the third embodiment of the ink-jet printing apparatus according to the invention.

FIG. 14 is a flowchart showing one example of the printing operation having the above-mentioned black enhancing printing mode.

At a step S111, judgement is made for initiation of printing by detecting a print data fed from a host system, for example. Then, at a step S112, judgement is made whether the black enhanced printing mode is set or not. It should be appreciated that the setting of the black enhanced printing mode can be set manually by the operator, or, in the alternative by the host system with judgement on the basis of the image data and feeding the result of judgement in a form of a mode signal.

When judgement is made that the black enhanced mode is set at the step S112, printing operation under black enhanced mode is performed at a step S113. In the shown case, printing for black is performed by scanning twice. Amongst, in at least one of the scans, any one of the modified embodiments of the second embodiment will be used.

On the other hand, when judgement is made that the black enhanced printing mode is not set as checked at the step S112, namely, in case of the normal printing mode, the printing operation under normal printing mode is performed at the step S114. In the normal printing mode, the black image is printed only by the black ink. For example, in the case that a printing operation is performed by using the head as shown in FIG. 13C, a black region of an image is printed by the black ink of cation type and a region other than the black region is printed by other color ink, in accordance with an image data. In this case, when other color ink which reacts with the black ink of cation type is ejected to a region adjacent to the black region, a reaction of other color ink with the black ink occurs on a boundary region between the region and the black region so that the bleeding can be prevented.

It should be noted that, in implementation of the present invention, the ink to be used is not limited to the dye ink, but can be a pigment ink. Also, the cation type ink to be employed may be the one which causes coagulation of the pigment. As one example of the pigment inks which may cause coagulation as mixed with the cation type ink are as follow: namely, as set out below, the yellow, magenta, cyan and black inks Y2, M2, C2 and K2 can be obtained, each of which contains pigment and anion type compound.

Black Ink K2

With employing anion type high polymer (stylen-metacrylic acid-ethylacrylate, acid value 400, average molecule by weight 6,000, water solution containing 20% of solid component, neutrizer: potassium hydroxide) as dispersing agent, the following materials were set in a diameter of glass beads as medium were also filled as a medium, in a batch the vertical sand mill to perform dispersing process for three hours. After dispersion, the viscosity was 9 cps, and pH was 10.0. The dispersed liquid is applied to a centrifugal separator to remove large grain. Thus, a carbon black having average molecule by weight is 100 nm.

| (Composition of carbon black dispersed body) | |
|---|---|
| P-1 water solution (solid component 20%) | 40 parts |
| carbon black Mogul L (Cyablack) | 24 parts |
| glycerine | 15 parts |
| ethyleneglycol monobutyl ether | 0.5 parts |
| isopropyl alcohol | 3 parts |
| water | 135 parts |

Next, the obtained dispersed body is sufficiently diffused to obtain the black ink K2 for ink-jet printing containing pigment. The solid component in the finally prepared black ink was approximately 10%.

Yellow ink Y2

With employing anion type high polymer (stylen-acrylic acid-methylacrylate, acid value 280, average molecule by weight 11,000, water solution containing 20% of solid component, neutralizer: diethanolamine) as dispersing agent, using the following materials, the dispersing process similar to preparation of black ink K2 was performed. Thus, a yellow color dispersed body having average grain size by weight of 103 nm was prepared.

| (Composition of Yellow dispersing body) | |
|---|---|
| P-2 water solution (solid component 20%) | 35 parts |
| C. I. pigment yellow-180 (Novabarm yellow PH-G Hoechst) | 24 parts |
| triethlene glycol | 10 parts |
| diethylene glycol | 10 parts |

-continued

| (Composition of Yellow dispersing body) | |
|---|---|
| ethylenglycol monobutyl ether | 1.0 parts |
| isopropyl alcohol | 0.5 parts |
| water | 135 parts |

By sufficiently diffusing the yellow color dispersed body, the yellow ink Y2 for ink-jet printing containing the pigment could be obtained. The solid component in the final product was approximately 10%.

Cyan Ink C2

Using the anion type high polymer P-1 used in preparation of the black ink K2, as the dispersing agent, and with using the following material, the dispersing process similar to the process in the case of carbon black dispersing body, a cyan color dispersed body having average grain size by weight of 120 nm was obtained.

| (Composition of Cyan dispersing body) | |
|---|---|
| P-1 water solution (solid component 20%) | 30 parts |
| C. I. pigment blue-15:3 (Fastgenble-FGF, Dai Nippon Ink Kagaku K.K.) | 24 parts |
| glycerine | 15 parts |
| diethylengylcol monobutyl ether | 0.5 parts |
| isopropyl alcohol | 3 parts |
| water | 135 parts |

By sufficiently diffusing the cyan color dispersed body obtained through the process set forth above, the cyan ink C2 for ink-jet printing containing pigment was obtained. The solid component of the finally prepared ink was approximately 9.6%.

Magenta Ink M2

Using the anion type high polymer P-1 used in preparation of the black ink K2, as the dispersing agent, and with using the following material, the dispersing process similar to the process in the case of carbon black dispersing body, a magenta color dispersed body having average grain size by weight of 115 nm was obtained.

| (Composition of Magenta dispersing body) | |
|---|---|
| P-1 water solution (solid component 20%) | 20 parts |
| C. I. pigment red 122 (Dai Nippon Ink Kagaku K. K.) | 24 parts |
| glycerine | 15 parts |
| isopropyl alcohol | 3 parts |
| water | 135 parts |

By sufficiently diffusing the magenta color dispersed body obtained through the process set forth above, the magenta ink C2 for ink-jet printing containing pigment was obtained. The solid component of the finally prepared ink was approximately 9.2%.

The present invention achieves a distinct effect when applied to a recording head or a recording apparatus which has means for generating thermal energy such as electro-thermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 15:
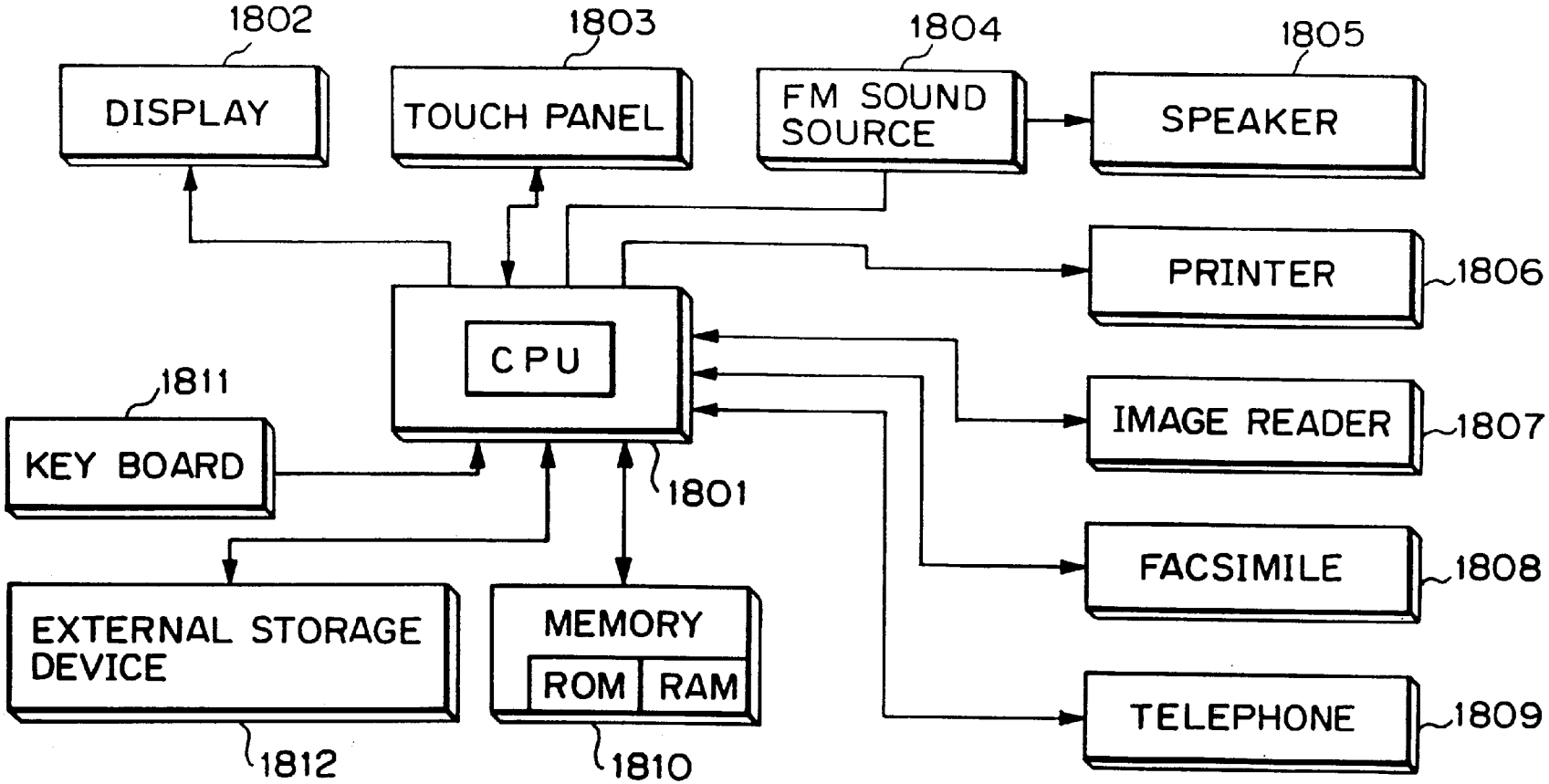
FIG. 15 is a block diagram showing an information processing system employing respective embodiments of the ink-jet printing apparatus.

FIG. 15 is a block diagram showing a general construction of an information processing apparatus having a function of wordprocessor, personal computer, facsimile machine, a copy machine and so forth, to which the printing apparatus according to the present invention is applied.

In the drawings, a reference numeral 1801 denotes a control portion performing control of the overall apparatus, which includes a CPU, such as a microprocessor and so forth, and various I/O ports, to perform control for outputting a control signal or data signal and so forth to respective portions and inputting control signal or data signal from the respective portions. A reference numeral 1802 denotes a display portion having a display screen, on which various menu, document information and image or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes a FM (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer portion 1806 is employed as an output terminal of the wordprocessor, the personal computer, the facsimile machine, the copy machine and so forth, in which the printing apparatus according to the present invention is applied.

A reference numeral 1807 denotes an image reader portion for optoelectrically reading out an original data for inputting, which is located at the intermediate position in an original feeding path and performs reading out various original document, such as original document for facsimile machine or copy machine. A reference numeral 1808 denotes a facsimile (FAX) transmission and reception portion for transmitting original data read by the image reader portion or for receiving transmitted facsimile signal, which facsimile transmission and reception portion has an external interface function. A reference numeral 1809 denotes a telephone machine portion having a normal telephone function and various associated functions, such as a recording telephone and so forth.

A reference numeral 1810 denotes a memory portion including a ROM storing a system program, a manager program, other application program and so forth, as well as character fonts, dictionary and so forth, a RAM for storing application program loaded from an external storage device 1812, document information, video information and so forth.

A reference numeral 1811 denotes a keyboard portion inputting document information or various commands. A reference numeral 1812 denotes the external storage device employing a floppy disc or hard disc drive as storage medium. In the external storage device 1812, document information, music or speech information, application program of the user and so forth are stored.

Figure 16:
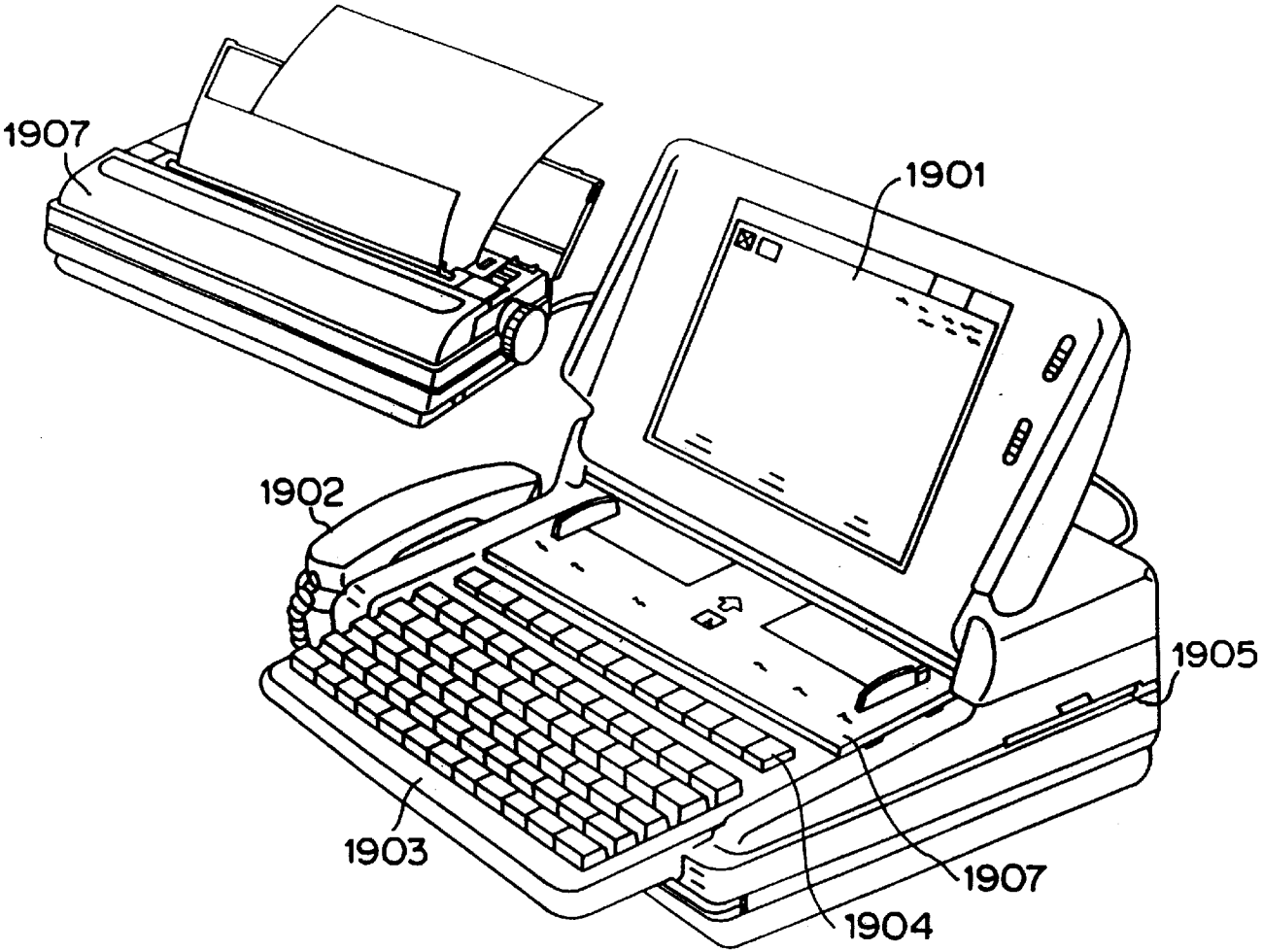
FIG. 16 is a perspective view showing an external appearance of the system of FIG. 15.

FIG. 16 is a diagrammatic external view of the information processing system shown in FIG. 15.

In FIG. 16, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth is operated as the personal computer or the wordprocessor, various information input through the keyboard portion 1811 is processed according to a predetermined program by the control portion 1801 and output as printed image by the printer portion 1806.

When the information processing apparatus is operated as a receiver of the facsimile machine, facsimile information input from the FAX transmission and reception portion 1808 via a communication network is subject to a reception process according to the predetermined program and is output as in received image by the printer portion 1808.

In addition, when the information processing apparatus is operated as a copy machine, the original is read by the image reader portion 1807 and the read original data is output to the printer portion as copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 17:
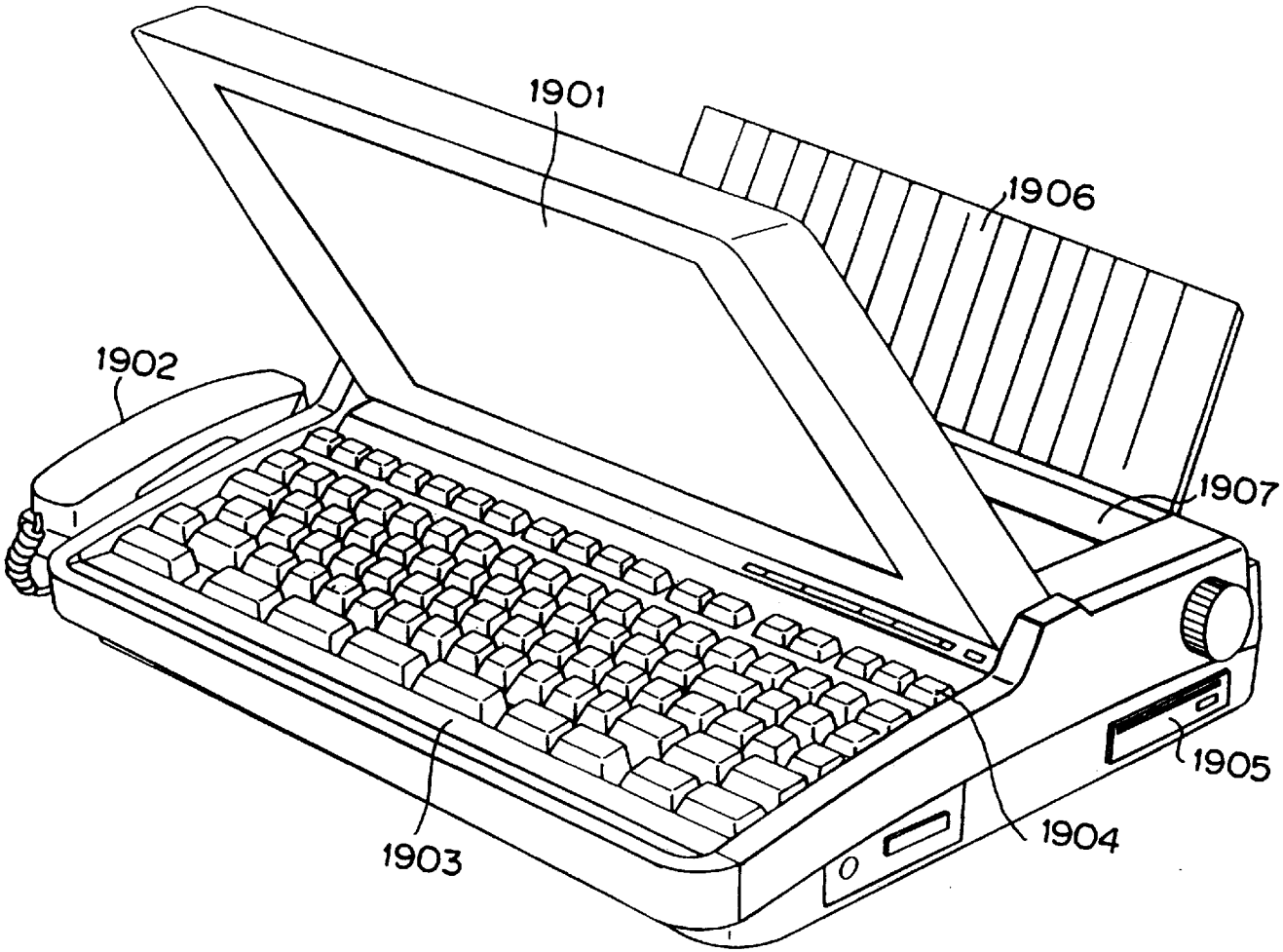
FIG. 17 is an external view showing another example of the system of FIG. 15.

It should be noted that the information processing apparatus may be an integrated type incorporating the ink-jet printer within a main body as illustrated in FIG. 17. In this case, portability can be further improved. In FIG. 17, the portions having the same function to FIG. 16 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

What is claimed is:

1. An ink-jet printing apparatus performing printing by ejecting at least one kind of ink and an ink composition containing a component making a coloring agent in the ink insoluble or coagulated, to a printing medium, said apparatus comprising:

moving means for moving a plurality of first ejecting portions of said apparatus for ejecting the at least one kind of ink and a second ejecting portion of said apparatus for ejecting the ink composition relative to the printing medium in at least one direction;

a supporting member for supporting the plurality of first ejecting portions and the second ejecting portion in the at least one direction; and printing control means for controlling movement by said moving means, and for controlling ejection of ink from one of the plurality of first ejecting portions and ejection of the ink composition from the second ejecting portion, such that the ink composition is ejected to a portion where the ink from one of the plurality of first ejecting portions is ejected, one of the ink ejected from one of the plurality of first ejecting portions and the ink composition containing a black ink, said printing control means further controlling ejection of ink such that a color ink other than the black ink from at least one of the plurality of first ejecting portions is ejected to a portion where the black ink is ejected so that printing for an enhanced black dot is performed, wherein the enhanced black dot has a higher density than a dot formed using only the black ink.

2. An ink-jet printing apparatus as claimed in claim 1, wherein said supporting member is provided for supporting one of the plurality of first ejecting portions and the second ejecting portion adjacent to each other or at most distant positions.

3. An ink-jet printing apparatus as claimed in claim 2, wherein the component to make the ink insoluble or coagulated contains a low molecule component and high molecule component of a cation type substance, and the plurality of kinds of inks contain an anion type dye.

4. An ink-jet printing apparatus as claimed in claim 2, wherein the component to make the ink insoluble or coagulated contains a low molecule component and high molecule component of a cation type substance, and the plurality of kinds of inks contain an anion type compound and a pigment.

5. An ink-jet printing apparatus as claimed in claim 2, wherein the plurality of first ejecting portions comprise means for ejecting the ink by utilizing thermal energy, and the second ejecting portion comprises means for ejecting the ink component by utilizing thermal energy.

6. An ink-jet printing apparatus as claimed in claim 1, wherein the ink composition includes a coloring agent of cyan and the ink ejected to the portion where the ink composition is ejected includes a coloring agent of black.

7. An ink-jet printing apparatus performing printing by ejecting a plurality of kinds of inks and an ink composition containing a component making a coloring agent in the ink insoluble or coagulated, to a printing medium, said apparatus comprising:

a plurality of first ejection portions of said apparatus for ejecting the plurality of kinds of inks;

a second ejecting portion of said apparatus for ejecting the ink composition;

setting means for setting a black enhanced mode performing printing by increasing density of a black image; and black enhanced mode executing means for, when the black enhanced mode is set, controlling ejection of ink from one of said plurality of first ejecting portions and ejection of the ink composition from said second ejecting portion, such that the ink composition is ejected to a portion where the ink from one of the plurality of first ejecting portions is ejected, one of the ink ejected from one of said plurality of first ejecting portions and the ink composition containing a black ink, said black enhanced mode executing means further controlling ejection of ink such that an ink other than the black ink from at least one of said plurality of first ejecting portions is ejected to a portion where the black ink is ejected so that printing for a black pixel is performed, wherein the black pixel has a higher density than a pixel formed using only the black ink.

8. An ink-jet printing apparatus as claimed in claim 7, wherein the ink composition includes a coloring agent of cyan and the ink ejected to the portion where the ink composition is ejected includes a coloring agent of black.

9. An ink-jet printing apparatus performing printing by ejecting at least one kind of ink and an ink composition containing a component making a coloring agent in the ink insoluble or coagulated, said apparatus comprising:

a plurality of first ejection portions of said apparatus for ejecting the at least one kind of ink;

a second ejecting portion of said apparatus for ejecting the ink composition;

setting means for setting a black enhanced mode performing printing by increasing density of a black image; and black enhanced mode executing means for, when the black enhanced mode is set, controlling ejection of the ink from one of said plurality of first ejecting portions, and ejection of the ink composition from said second ejecting portion, such that the ink composition is ejected to a portion where the ink is ejected, one of the ink ejected from one of said plurality of first ejecting portions and the ink composition containing a black ink, so that printing for a black pixel is performed, wherein the black pixel has a higher density than a pixel formed using only the black ink.

10. An ink-jet printing apparatus as claimed in claim 9, wherein the ink composition includes a coloring agent of cyan and the ink ejected to the portion where the ink composition is ejected includes a coloring agent of black.

11. A method of enhancing a black color in performing printing by ejecting a plurality of kinds of inks including at least a black ink, and a color ink containing a component making a coloring agent in the ink insoluble or coagulated, to a printing medium, said method comprising the steps of:

providing an apparatus having a plurality of first ejecting portions for ejecting the plurality of kinds of inks and a second ejecting portion for ejecting the color ink containing the component making the coloring agent in the ink ejected through said first ejecting portions insoluble or coagulated; and printing a black pixel by ejecting a black ink from one of the plurality of first ejecting portions, by ejecting the color ink containing the component from the second ejecting portion to the portion where the black ink is ejected, and by ejecting an ink other than the black ink from one of the plurality of first ejecting portions to a portion where the black ink is ejected wherein the black pixel has a higher density than a pixel formed using only the black ink.

12. A method as claimed in claim 11, wherein the ink containing the component includes a coloring agent of cyan and the black ink ejected to the portion where the ink containing the component is ejected includes a coloring agent of black.

13. A method for enhancing a black pixel in an ink-jet printing for performing printing by ejecting a plurality of inks including at least a black ink, and a color ink containing a component making a coloring agent in the plurality of inks insoluble or coagulated, to a printing medium, said method comprising the steps of:

providing an apparatus having a plurality of first ejecting portions for ejecting the plurality of kinds of inks and a second ejecting portion for ejecting the color ink containing the component making the coloring agent in the ink ejected through the plurality of first ejecting portions insoluble or coagulated; and printing a black pixel by ejecting a black ink from one of the plurality of first ejecting portions, by ejecting the color ink containing the component from the second ejecting portion to a portion where the black ink is ejected, and by ejecting an ink other than the black ink from one of the plurality of first ejecting portions to a portion where the black ink is ejected wherein the black pixel has a higher density than a pixel formed using only the black ink.

14. A method as claimed in claim 13, wherein the ink containing the component includes a coloring agent of cyan and the black ink ejected to the portion where the ink containing the component is ejected includes a coloring agent of black.

15. A method for enhancing a black pixel in an ink-jet printing for performing printing by ejecting at least one kind of ink and an ink composition containing a component making a coloring agent in the ink insoluble or coagulated, to a printing medium, said method comprising the steps of:

providing an apparatus having a plurality of first ejecting portions for ejecting the at least one kind of ink, and a second ejecting portion for ejecting the ink composition;

setting a black enhanced mode performing printing by increasing density of a black image; and printing a black pixel by, when the black enhanced mode is set, controlling ejection of ink from one of the plurality of first ejecting portions and ejection of the ink composition from the second ejecting portion, such that the ink composition is ejected to a portion where the ink from one of the plurality of first ejecting portions is ejected, one of the ink ejected from one of the plurality of first ejecting portions and the ink composition containing a black ink, and further controlling ejection of ink such that an ink other than the black ink from at least one of the plurality of first ejecting portions is ejected to a portion where the black ink is ejected wherein the black pixel has a higher density than a pixel formed using only the black ink.

16. A method as claimed in claim 15, wherein the ink composition includes a coloring agent of cyan and the ink ejected to the portion where the ink composition is ejected includes a coloring agent of black.

17. A method for enhancing a black pixel in an ink-jet printing for performing printing by ejecting at least one kind of ink and an ink composition containing a component making a coloring agent in the ink insoluble or coagulated, said method comprising the steps of:

providing an apparatus having a plurality of first ejecting portions for ejecting the at least one kind of ink, and a second ejecting portion for ejecting the ink composition;

setting a black enhanced mode performing printing by increasing density of a black image; and printing a black pixel by, when the black enhanced mode is set, controlling ejection of the ink from one of the plurality of first ejecting portions, and ejection of the ink composition from the second ejecting portion, such that the ink composition is ejected to a portion where the ink is ejected, one of the ink ejected from one of the plurality of first ejecting portions and the ink composition containing a black ink, wherein the black pixel has a higher density than a pixel formed using only the black ink.

18. A method as claimed in claim 17, wherein the ink composition includes a coloring agent of cyan and the ink ejected to the portion where the ink composition is ejected includes a coloring agent of black.

19. A method of enhancing a black color in forming a black type pixel, said method comprising the steps of:

employing a black type ink and a color ink having a color different from the black type ink; and ejecting one of the black type ink and the color ink to a position where the other ink is ejected, to form the black type pixel on a printing medium, wherein a first component contained in the black type ink and a second component contained in the color ink are components causing a mutual chemical reaction, and wherein the black type pixel has a higher density than a pixel formed using only the black type ink.

20. A method as claimed in claim 19, wherein the first component is a dye, and the second component is a polymer.

21. A method as claimed in claim 19, wherein the first component is a polymer and the second component is a dye.

22. A method as claimed in claim 19, wherein the first component is a dye and the second component is a dye.

23. A method as claimed in claim 19, wherein the first component is a first dye and a first polymer and the second component is a second dye and a second polymer.

24. A method as claimed in claim 19, wherein the color ink includes a coloring agent of cyan and the black type ink includes a coloring agent of black.

25. An ink-jet printing apparatus performing printing by ejecting at least one kind of ink and an ink composition containing a component making a coloring agent in the ink insoluble or coagulated, to a printing medium, said apparatus comprising:

moving means for moving a plurality of first ejecting portions of said apparatus for ejecting the at least one kind of ink and a second ejecting portion of the apparatus for ejecting the ink composition relative to the printing medium; and printing control means for controlling movement by said moving means, and for controlling ejection of ink from one of the plurality of first ejecting portions and ejection of the ink composition from the second ejecting portion, such that the ink composition is ejected to a portion where the ink from one of the plurality of first ejecting portions is ejected, one of the ink ejected from one of the plurality of first ejecting portions and the ink composition containing a black ink and the other containing a color ink other than the black ink, so that printing for an enhanced black dot is performed, wherein the enhanced black dot has a higher density than a dot formed using only the black ink.

26. An ink-jet printing apparatus as claimed in claim 25, wherein the ink composition includes a coloring agent of cyan and the ink ejected to the portion where the ink composition is ejected includes a coloring agent of black.

27. An ink-jet printing apparatus performing printing by ejecting at least one kind of ink other than black ink and a black ink composition containing a component making a coloring agent in the ink insoluble or coagulated, to a printing medium, said apparatus comprising:

moving means for moving a first ejecting portion of said apparatus for ejecting the at least one kind of ink and a second ejecting portion of said apparatus for ejecting the black ink composition relative to the printing medium; and printing control means for controlling movement by said moving means, and for controlling ejection such that only the black ink composition from the second ejecting portion is ejected to a black image region, and the at least one kind of ink from the first ejecting portion is ejected to an image region of a color other than black color in accordance with image data, so that printing for an enhanced black dot is performed, wherein the enhanced black dot has a higher density than a dot formed using only the black ink composition.

28. An ink-jet printing apparatus as claimed in claim 27, wherein the ink other than black ink includes a coloring agent of cyan and the black ink composition includes a coloring agent of black.

29. An ink-jet printing apparatus performing printing by ejecting at least one kind of ink and an ink composition containing a component making a coloring agent in the ink insoluble or coagulated, to a printing medium, said apparatus comprising:

moving means for moving a plurality of first ejecting portions of said apparatus for ejecting the at least one kind of ink and a second ejecting portion of said apparatus for ejecting the ink composition relative to the printing medium; and printing control means for controlling movement by said moving means, and for controlling ejection of ink from one of the plurality of first ejecting portions and ejection of the ink composition from the second ejecting portion, such that the ink composition is ejected to a portion where the ink from one of the plurality of first ejecting portions is ejected, one of the ink ejected from one of the plurality of first ejecting portions and the ink composition containing a black ink, said printing control means further controlling election of ink such that an ink other than the black ink from at least one of the plurality of first ejecting portions is ejected to a portion where the black ink is ejected or a portion in the vicinity thereof, so that printing for an enhanced black dot is performed, wherein the enhanced black dot has a higher density than a dot formed using only the black ink.

30. An ink-jet printing apparatus as claimed in claim 29, wherein the ink composition includes a coloring agent of cyan and the ink ejected to the portion where the ink composition is ejected includes a coloring agent of black.

31. A method of printing by ejecting at least one kind of ink and an ink composition containing a component making a coloring agent in the ink insoluble or coagulated, to a printing medium, said method comprising the steps of:

providing an apparatus having a plurality of first ejecting portions for ejecting the at least one kind of ink, and a second ejecting portion for ejecting the ink composition; and printing a black pixel by controlling so as to eject ink from one of the plurality of first ejecting portions, and to eject the ink composition from the second ejecting portion to a portion where the ink from one of the plurality of first ejecting portions is ejected, one of ink ejected from one of the plurality of first ejecting portions and the ink composition containing a black ink and the other containing a color ink other than the black ink, wherein the black pixel has a higher density than a pixel formed using only the black ink.

32. A method as claimed in claim 31, wherein the ink composition includes a coloring agent of cyan and the ink ejected to the portion where the ink composition is ejected includes a coloring agent of black.

33. A method of forming a black type pixel, said method comprising the step of:

employing a black type ink and a color ink having a color different from the black type ink; and ejecting one of the black type ink and the color ink to a position where the other ink is ejected, to form the black type pixel on a printing medium, wherein a first component contained in the black type ink and a second component contained in the color ink are components causing a mutual chemical reaction, and whrein the black type pixel has a higher density than a pixel formed using only the black type ink.

34. An ink-jet printing apparatus performing printing by ejecting a first ink and a second ink containing a component making a coloring agent in the first ink insoluble or coagulated, to a printing medium, said apparatus comprising:

moving means for moving a first ejecting portion of said apparatus for ejecting the first ink and a second ejecting portion of the apparatus for ejecting the second ink relative to the printing medium; and printing control means for controlling movement by said moving means, and for controlling ejection of the first ink from the first ejecting portion and ejection of the second ink from the second ejecting portion, such that the second ink is ejected to a portion where the first ink is ejected, one of the first ink and the second ink containing a black ink and the other containing a color ink other than the black ink, so that printing for an enhanced black dot is performed, wherein the enhanced black dot has a higher density than a dot formed using only the black ink.

35. A method of printing by ejecting a first ink and a second ink containing a component making a coloring agent in the first ink insoluble or coagulated, to a printing medium, said method comprising the steps of:

providing an apparatus having a first ejecting portion for ejecting the first ink, and a second ejecting portion for ejecting the second ink; and printing a black pixel by controlling so as to eject the first ink from the first ejecting portion, and to eject the second ink from the second ejecting portion to a portion where the first ink is ejected, one of the first ink and the second ink containing a black ink and the other containing a color ink other than the black ink, wherein the black pixel has a higher density than a pixel formed using only the black ink.

36. A printed product having a black dot, said printed product being formed by a method comprising the step of forming a plurality of dots by ejecting an ink and an ink composition containing a component making a coloring agent in the ink insoluble or coagulated to a printing medium, wherein at least one of a plurality of dots are formed by a component in the ink and a component in the ink composition, and one of the ink and the ink composition includes a black coloring agent, and the other includes a coloring agent other than the black coloring agent, and the black coloring agent is made insoluble or coagulated on the printing medium.

37. A printed product as claimed in claim 36, wherein the ink composition includes a coloring agent of cyan and the ink includes a coloring agent of black.

* * * * *

UNITED STATES PATENT AND TRADEMARK OFFICE

CERTIFICATE OF CORRECTION

PATENT NO. : 6,062,674
DATED : May 16, 2000
INVENTOR(S) : Toshiharu Inui, et al.

It is certified that error appears in the above-identified patent and that said Letters Patent is hereby corrected as shown below:

Column 1,
Line 28, "uncom-" should read -- com- --.
Line 60, "In this" should read -- This --.
Line 66, "lowering of the through-put" should read -- a lowering of the throughput --.

Column 2,
Line 62, "lower" should read -- black --.

Column 3,
Line 3, "ink" (first occurrence) should read -- inks --.
Line 16, "other" should read -- another --.
Line 65, "portions" should read -- portion --.

Column 4,
Line 10, "image;" should read -- image; and --.
Line 62, "to a printing medium," should be deleted.

Column 5,
Line 43, "portion" should read -- portions --.

Column 6,
Line 9, "a" should read -- an --.

Column 8,
Line 48, "a" should be deleted.

Column 9,
Line 8, "front" should read -- from the front --.

Column 10,
Line 19, "following" should read -- the following --.

Column 11,
Line 10, "colors" should read -- color -- and "color" should read -- colors --.
Line 40, "wood free" should read -- wood-free --.
Line 58, "causes" should read -- cause --.

UNITED STATES PATENT AND TRADEMARK OFFICE

CERTIFICATE OF CORRECTION

PATENT NO. : 6,062,674
DATED : May 16, 2000
INVENTOR(S) : Toshiharu Inui, et al.

It is certified that error appears in the above-identified patent and that said Letters Patent is hereby corrected as shown below:

Column 13,
Lines 55 and 56, "agent" should read -- agents --.

Column 15,
Line 41, "in" should read -- to a --.
Line 42, "level" should read -- extent --.
Line 47, "color" should read -- colors --.

Column 21,
Line 45, "consists" should read -- consist --.

Column 23,
Lines 25 and 27, "program" should read -- programs --.
Line 36, "gram" should read -- grams --.

Column 29,
Line 8, "election" should read -- ejection --.
Line 53, "whrein" should read -- wherein --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*